US008887466B2

(12) United States Patent
Alvarez Moysen

(10) Patent No.: US 8,887,466 B2
(45) Date of Patent: Nov. 18, 2014

(54) SYSTEM FOR CONSTRUCTING WALLS USING BLOCKS EQUIPPED WITH COUPLING MEANS

(75) Inventor: Arturo Ramon Alvarez Moysen, Durango (MX)

(73) Assignee: Arturo Ramon Alvarez Moysen (MX)

( * ) Notice: Subject to any disclaimer, the term of this patent is extended or adjusted under 35 U.S.C. 154(b) by 0 days.

(21) Appl. No.: 13/991,528

(22) PCT Filed: May 13, 2011

(86) PCT No.: PCT/MX2011/000057

§ 371 (c)(1), (2), (4) Date: Jun. 4, 2013

(87) PCT Pub. No.: WO2012/078017

PCT Pub. Date: Jun. 14, 2012

(65) Prior Publication Data

US 2014/0007529 A1 Jan. 9, 2014

(30) Foreign Application Priority Data

Dec. 6, 2010 (MX) ..... MX/a/2010/013375

(51) Int. Cl.
*E04B 2/18* (2006.01)
*E04C 1/39* (2006.01)

(52) U.S. Cl.
USPC ..... 52/505; 52/220.2; 52/570; 52/590.3; 52/604; 52/605; 52/606; 52/745.1

(58) Field of Classification Search
CPC ..... E04C 1/00; E04C 1/39; E04C 1/397; E04C 2/044; E04C 2/06; E04B 2/16; E04B 2/22; E04B 2/44; E04B 2/50
USPC ..... 52/220.2, 505, 590.2, 590.3, 592.4, 52/592.6, 604–606, 608, 745.1
See application file for complete search history.

(56) References Cited

U.S. PATENT DOCUMENTS 2,655,032 A * 10/1953 Zagray ..... 52/591.1
3,478,482 A * 11/1969 Weir ..... 52/592.3
4,124,961 A 11/1978 Habegger (Continued)

FOREIGN PATENT DOCUMENTS

DE 3013520 A1 * 4/1980
DE 3013520 10/1981

(Continued)

OTHER PUBLICATIONS

International Search Report for PCT/MX2011/000057, English translation attached to original, Both completed by the Spanish Patent Office on Oct. 19, 2011, All together 11 Pages.

*Primary Examiner* — Adriana Figueroa
(74) *Attorney, Agent, or Firm* — Brooks Kushman P.C.

(57) ABSTRACT

The invention relates to a system for constructing walls using blocks equipped with coupling means, comprising blocks having: ridges that fit into grooves, bases that fit into channels, cavities for the flow of adhesive, notches in which ducts for installations are located, perforations for reinforcing the wall with post-tensioned cable or rebar, provisions for building frames for doors or windows, and tunnels for housing piers, among other elements, which together allow a wall to be constructed without skilled labor, saving materials and reducing construction time.

14 Claims, 36 Drawing Sheets

(56) References Cited

U.S. PATENT DOCUMENTS

| | | | | | |
|---|---|---|---|---|---|
| 4,314,431 | A | * | 2/1982 | Rabassa | 52/259 |
| 4,426,815 | A | * | 1/1984 | Brown | 52/100 |
| 4,485,604 | A | * | 12/1984 | Palamara et al. | 52/436 |
| 5,191,744 | A | * | 3/1993 | Bowes | 52/564 |
| 5,485,703 | A | * | 1/1996 | Nordahl | 52/562 |
| 5,623,797 | A | | 4/1997 | Gravier et al. | |
| 6,065,265 | A | * | 5/2000 | Stenekes | 52/607 |
| 6,082,067 | A | | 7/2000 | Bott | |
| 6,105,330 | A | * | 8/2000 | Nanayakkara | 52/606 |
| 6,223,493 | B1 | * | 5/2001 | Ruggeri | 52/592.6 |
| 6,298,632 | B1 | * | 10/2001 | Sherwood | 52/745.1 |
| 7,305,803 | B2 | * | 12/2007 | Correa et al. | 52/604 |
| 8,074,419 | B1 | * | 12/2011 | Humphress et al. | 52/607 |
| 2005/0108972 | A1 | | 5/2005 | Banova | |
| 2010/0018150 | A1 | * | 1/2010 | Azar | 52/606 |
| 2010/0236179 | A1 | | 9/2010 | Kim et al. | |
| 2012/0102868 | A1 | | 5/2012 | Janssens et al. | |

FOREIGN PATENT DOCUMENTS

| | | | |
|---|---|---|---|
| DE | 202007016365 | | 1/2008 |
| ES | 472250 | | 3/1979 |
| ES | 263907 | | 11/1982 |
| ES | 2237890 | | 8/2005 |
| FR | 1454026 | | 7/1966 |
| FR | 2939817 | | 6/2010 |
| RU | 2219315 | * | 9/2002 |
| RU | 2219315 | | 12/2003 |
| WO | 2004055287 | | 7/2004 |
| WO | 2007080182 | | 7/2007 |
| WO | 2010013991 | | 2/2010 |
| WO | 2010124345 | | 11/2010 |

* cited by examiner

SYSTEM FOR CONSTRUCTING WALLS USING BLOCKS EQUIPPED WITH COUPLING MEANS

CROSS-REFERENCE TO RELATED APPLICATION

This application is the U.S. national phase of PCT Application No. PCT/MX2011/000057 filed on May 13, 2011, which claims priority to Mexican Patent Application No. MX/a/2010/013375 filed on Dec. 6, 2010, the disclosures of which are incorporated in their entirety by reference herein.

OBJECT OF THE INVENTION

The system for constructing walls using blocks equipped with coupling means allows for the construction of walls in less time and with a cleaner, flatter and more homogeneous finish, since the mortar joints are avoided and replaced with very slightly visible seams, also achieving a more solid structure than that of traditional blocks or bricks, while saving adhesive material or mortar and avoiding the need for skilled labor to build the wall. All the above, considering also the channeling inside the wall for electrical installations or any kind of piping, without weakening the structure of the wall. This system also considers the construction of piers by stacking quoin blocks equipped with coupling means, on a rib previously set in the foundation. The system allows for the construction of walls without the need for skilled labor. The features of the blocks equipped with coupling means of the present system can reduce the volume of material used for its manufacture and can reduce its weight, without compromising its strength. The blocks equipped with coupling means have thermal characteristics due to the design of their cavities. The system is provided with blocks equipped with coupling means with different characteristics suitable for different purposes in the construction of a wall, which include the plinth courses, housing of ducting and reinforcement of the wall. The system also comprises attaching and fastening elements to the plinth surface, as well as longitudinal reinforcements making walls particularly resistant in seismic zones.

BACKGROUND OF THE INVENTION

Walls are traditionally built with blocks, by aligning them to form rows, called courses, inserting adhesive between one block and the next. The first course called plinth course, requires the placement of a layer of mortar on the plinth surface to bond the blocks to the plinth surface, each block requiring to be leveled and aligned, while assuring the correct thickness of the mortar joint. Courses are stacked one on top of another to the desired height, inserting adhesive between one course and the next one. The blocks used are hexahedral whose sides are comprise rectangular polygons and are called bricks. Some of the blocks used in the construction industry have holes from side to side to reduce their weight. Construction of walls requires each course to be fully aligned and leveled, both horizontally and vertically, so that each consecutive course, resting on the previous one, is aligned and leveled as well, therefore, adhesive or mortar must be applied carefully so that each block is leveled with the previous one. This requires the person building the wall to develop the ability to do it properly so that the wall remains aligned and leveled.

Once the wall is built, a crack is made on one or both sides to make a channel to house the ducting for electrical, water or gas installations, therefore weakening the structure of the wall and increasing the investment on time of skilled labor for its implementation. Next, it is needed to apply a finish to the wall to provide it with an even surface, which is accomplished by spreading a mixture of plaster, for the case of interior walls, or concrete for the case of exterior walls or facades. Achieving this even finish requires as of investment on time of skilled labor well.

There are designs for construction blocks as described in patent application WO 2010124345, which discloses a block for the construction of contention walls which can be assembled with a front panel for aesthetic purposes.

Patent US20100236179 shows a block for construction that serves as a template for the engineering and construction works.

The patent application FR2939817 discloses assembly blocks provided with protective outer coverings to keep uniform spacing between blocks.

Patent application WO 2007080182 shows a pair of blocks for construction that are assembled one on top of another with a rotational movement of their coupling means.

DETAILED DESCRIPTION OF THE INVENTION

Figure 1:
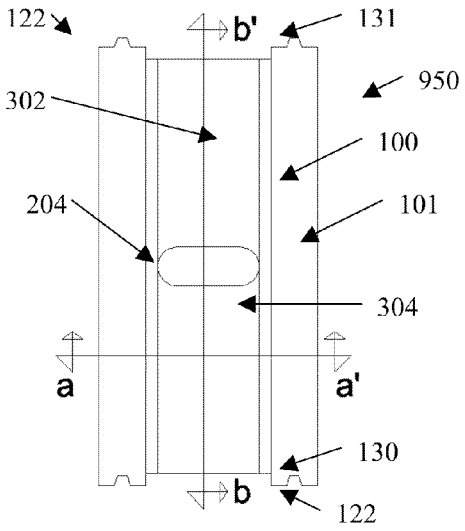
FIG. 1 is a top view of the plinth block (950), showing transverse cut (a-a') and longitudinal cut (b-b') lines.
Figure 2:
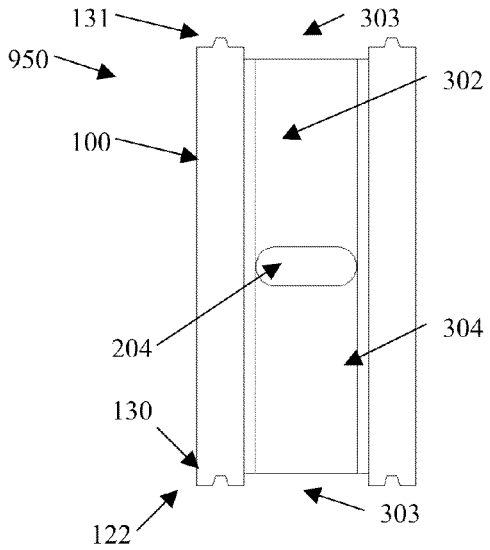
FIG. 2 is a bottom view of the plinth block (950).
Figure 3:
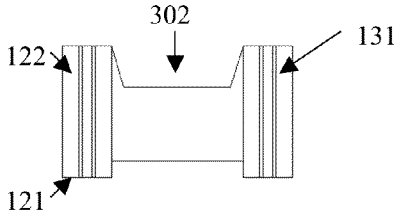
FIG. 3 is a side view of the plinth block (950).
Figure 4:
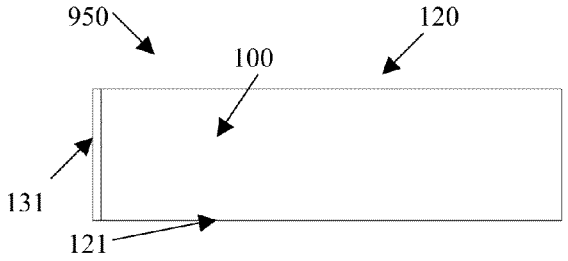
FIG. 4 is a front view of the plinth block (950).
Figure 5:
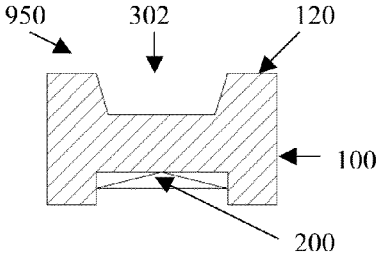
FIG. 5 is a transverse cut (a-a') view of the plinth block (950) shown in FIG. 1.
Figure 6:
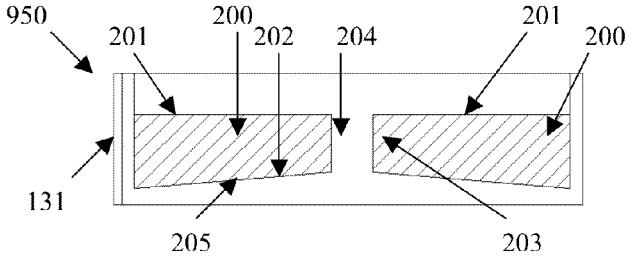
FIG. 6 is a longitudinal cut (b-b') view of the plinth block (950) shown in FIG. 1.
Figure 7:
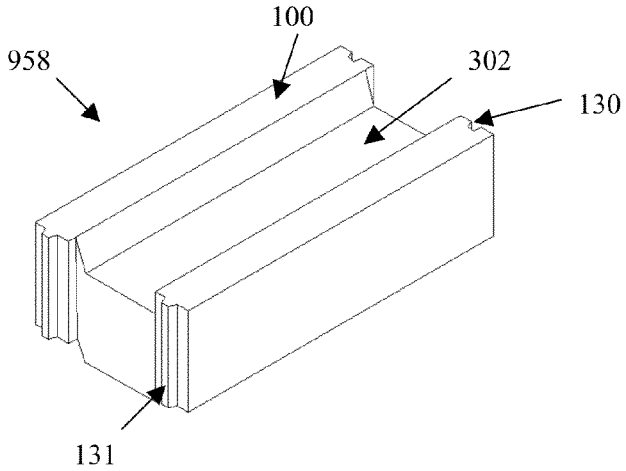
FIG. 7 is a top perspective view of the block equipped with coupling means.
Figure 8:
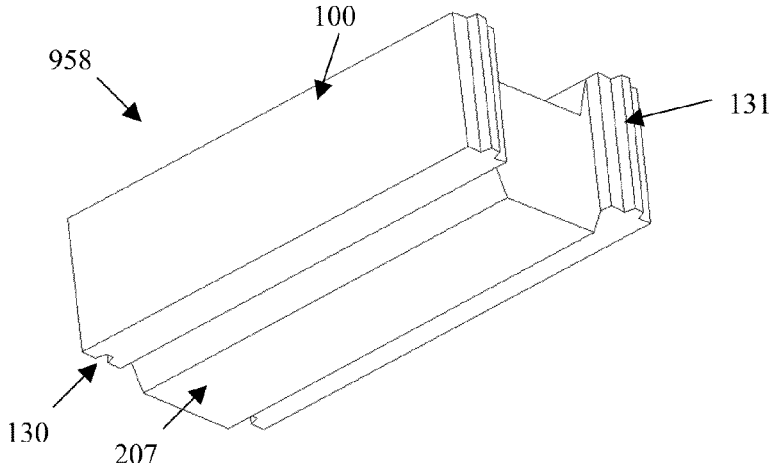
FIG. 8 is a bottom perspective view of the block equipped with coupling means.
Figure 9:
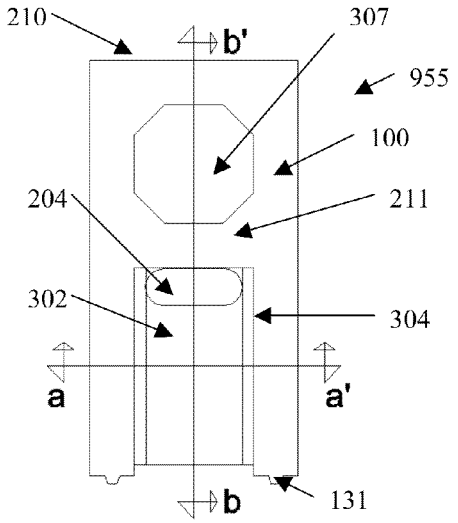
FIG. 9 is a top view of the quoin block (955) for plinth course showing transverse cut (a-a') and longitudinal cut (b-b') lines.
Figure 10:
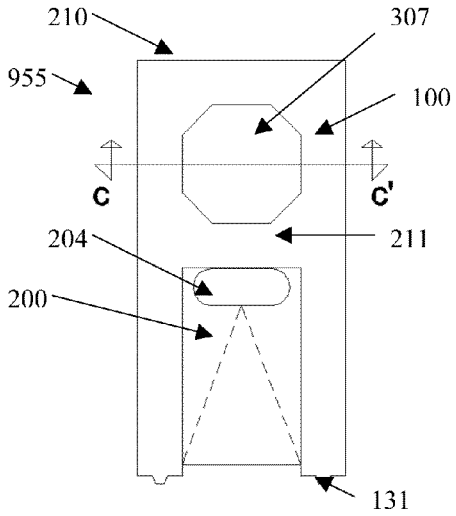
FIG. 10 shows a bottom view of the quoin block (955) for plinth course showing a transverse cut (c-c') line.
Figure 11:
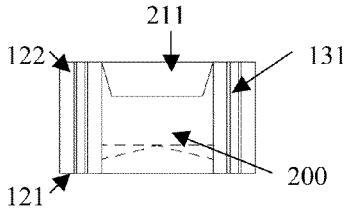
FIG. 11 is a side view of the quoin block (955) for plinth course.
Figure 12:
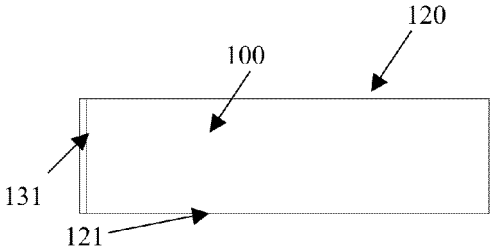
FIG. 12 is a front view of the quoin block (955) for plinth course.
Figure 13:
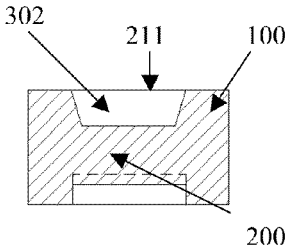
FIG. 13 is a transverse cut (a-a') view of the quoin block (955) for plinth course shown in FIG. 9.
Figure 14:
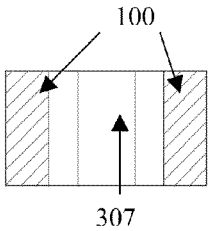
FIG. 14 is a transverse cut (c-c') view of the quoin block (955) for plinth course shown in FIG. 10.
Figure 15:
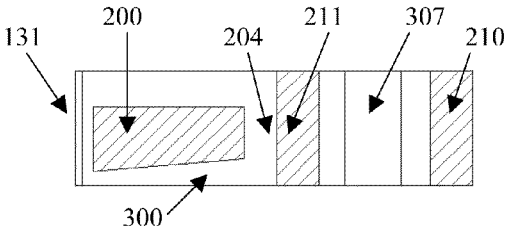
FIG. 15 is a longitudinal cut (b-b') view of the quoin block (955) for plinth course shown in FIG. 9.
Figure 16:
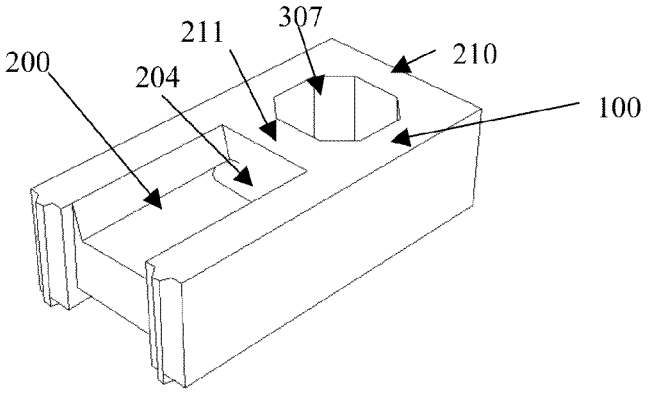
FIG. 16 is a top perspective view of the quoin block (955) for plinth course.
Figure 17:
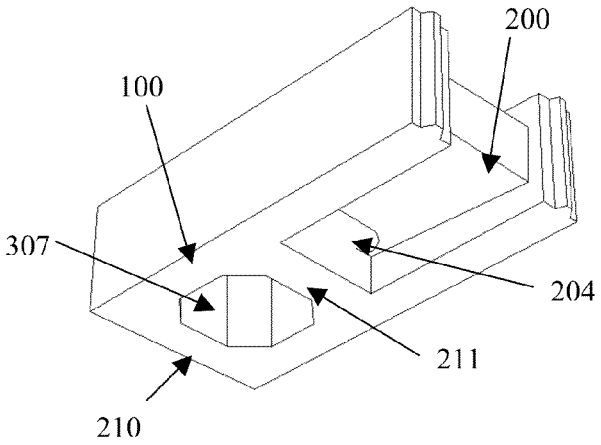
FIG. 17 is a bottom perspective view of the quoin block (955) for plinth course.
Figure 18:
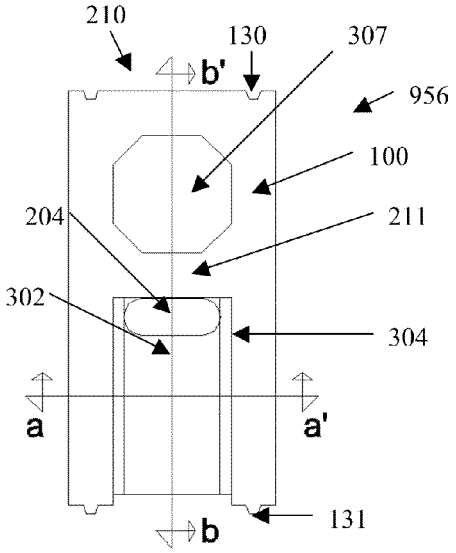
FIG. 18 is a top view of the continuation block (956) for plinth course showing transverse cut (a-a') and longitudinal cut (b-b') lines.
Figure 19:
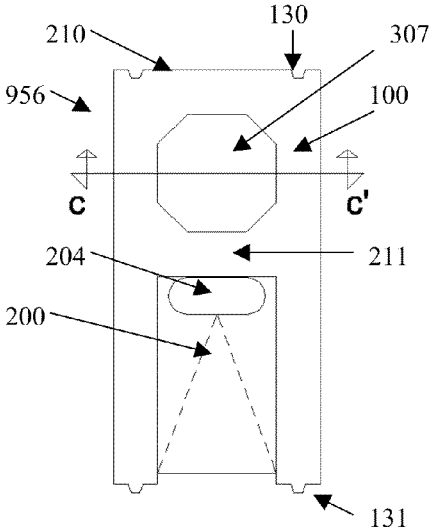
FIG. 19 is a bottom view of the continuation block (956) for plinth course showing a transverse cut (c-c') line.
Figure 20:
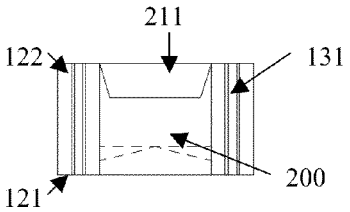
FIG. 20 is a side view of the continuation block (956) for plinth course.
Figure 21:
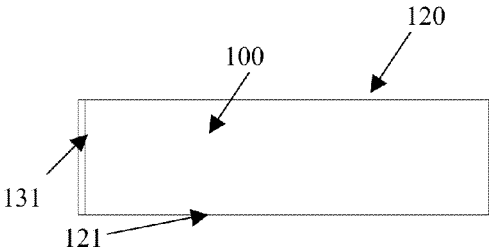
FIG. 21 is a front view of the continuation block (956) for plinth course.
Figure 22:
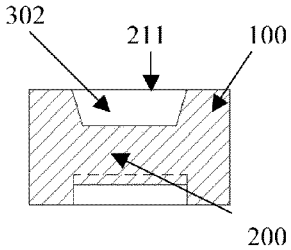
FIG. 22 is a transverse cut (a-a') view of the continuation block (956) for plinth course shown in FIG. 18.
Figure 23:
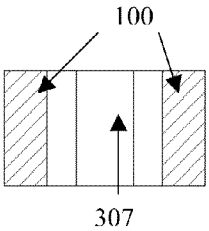
FIG. 23 is a transverse cut (c-c') view of the continuation block (956) for plinth course shown in FIG. 19.
Figure 24:
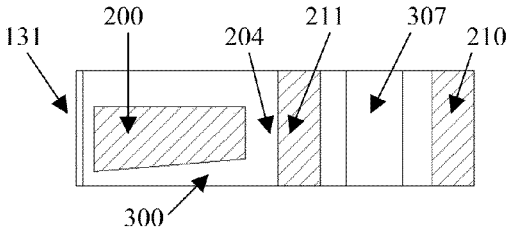
FIG. 24 is a longitudinal cut (b-b') view of the continuation block (956) for plinth course shown in FIG. 18.
Figure 25:
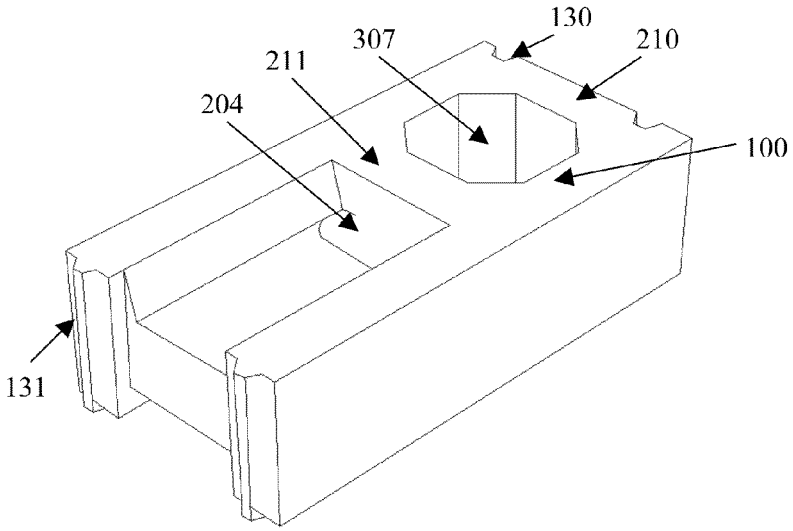
FIG. 25 is a top perspective view of the continuation block (956) for plinth course.
Figure 26:
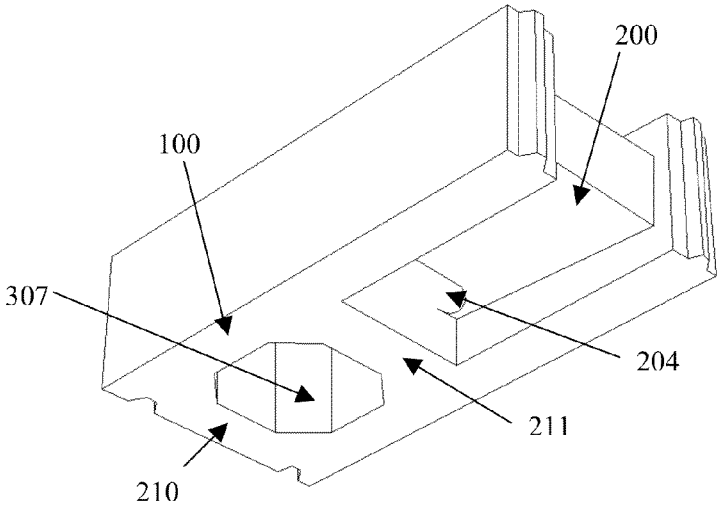
FIG. 26 is a bottom perspective view of the continuation block (956) for plinth course.
Figure 27:
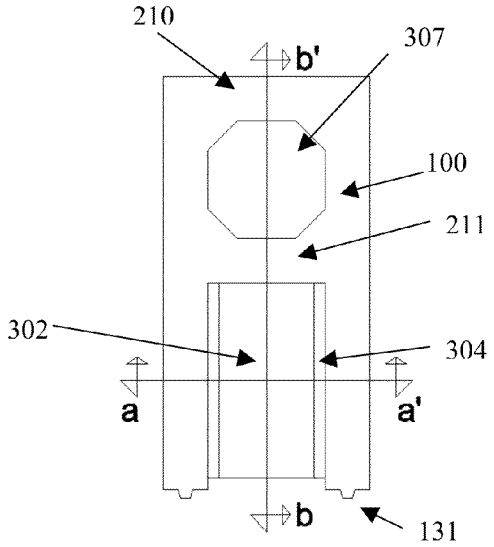
FIG. 27 is a top view of the quoin block (955) for course showing transverse cut (a-a') and longitudinal cut (b-b') lines.
Figure 28:
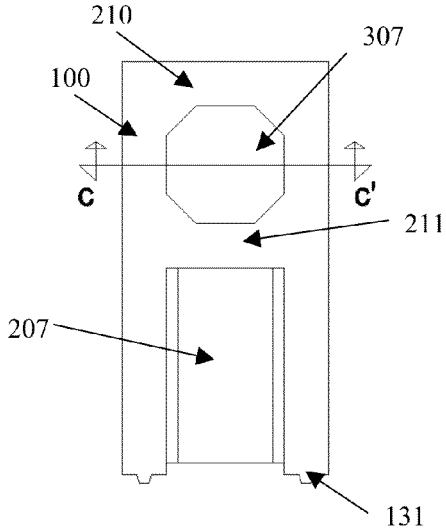
FIG. 28 is a bottom view of the quoin block (955) for course showing a transverse cut (c-c') line.
Figure 29:
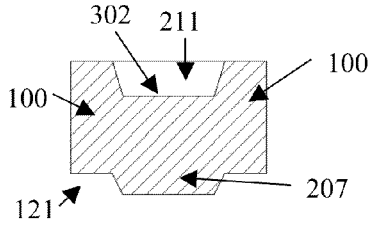
FIG. 29 is a transverse cut (a-a') view of the quoin block (955) for course, shown in FIG. 27.
Figure 30:
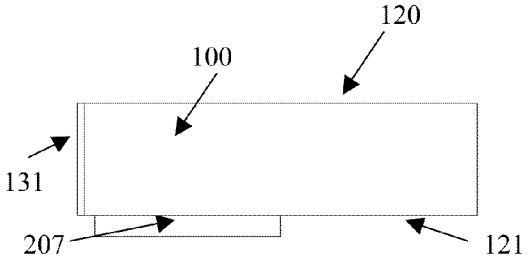
FIG. 30 is a front view of the quoin block (955) for course.
Figure 31:
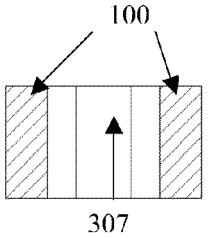
FIG. 31 is a transverse cut (c-c') view of the quoin block (955) for course, shown in FIG. 28.
Figure 32:
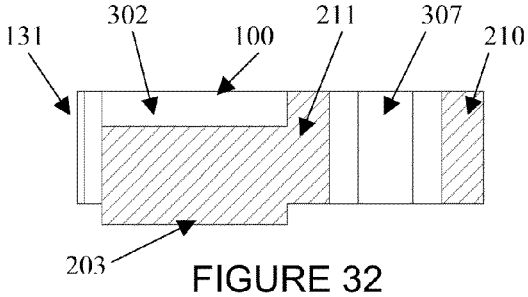
FIG. 32 is a longitudinal cut (b-b') view of the quoin block (955) for course, shown in FIG. 27.
Figure 33:
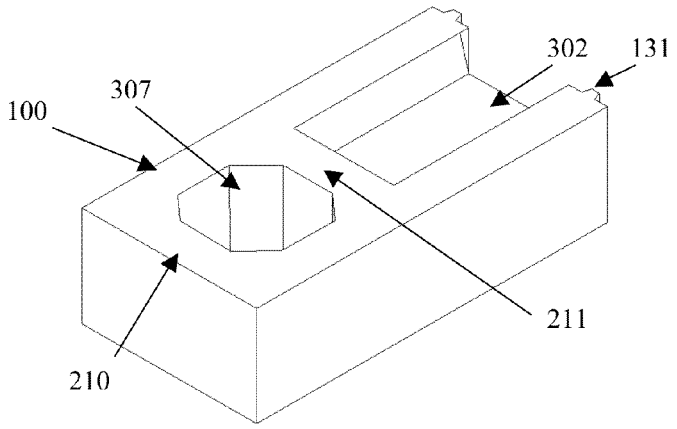
FIG. 33 is an outer top perspective view of the quoin block (955) for course.
Figure 34:
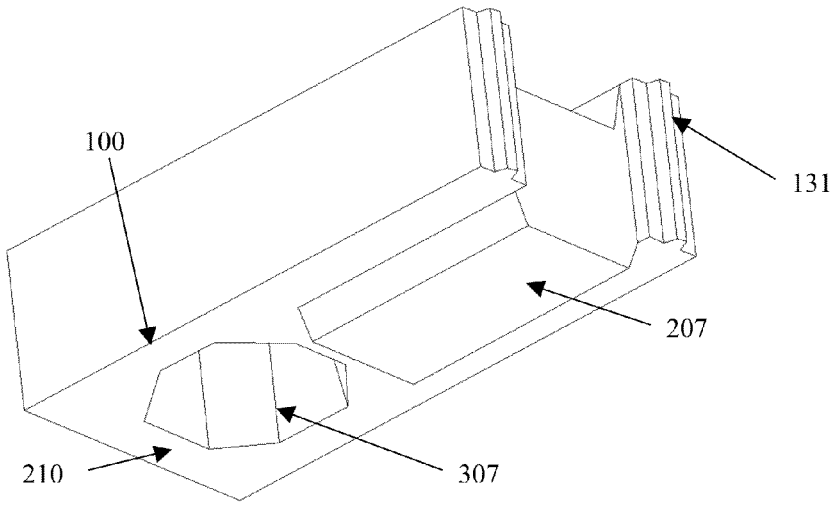
FIG. 34 is a bottom perspective view of the quoin block (955) for course.
Figure 35:
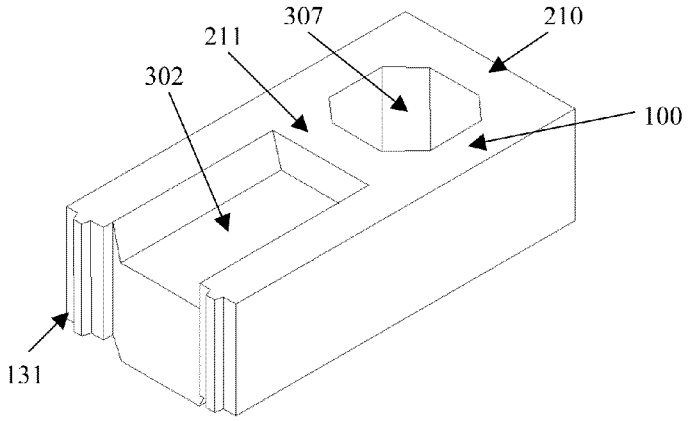
FIG. 35 is an inner top perspective view of the quoin block (955) for course.
Figure 36:
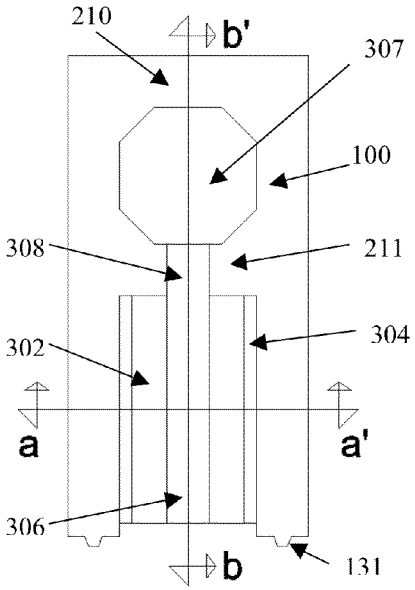
FIG. 36 is a top view of the quoin block (955) for course of ducting blocks (953) with a notch (306) in the channel (302), showing transverse cut (a-a') and longitudinal cut (b-b') lines.
Figure 37:
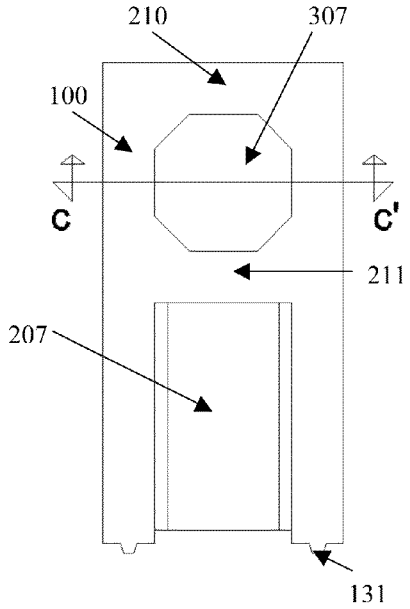
FIG. 37 is a bottom view of the quoin block (955) for course of ducting blocks (953) with a notch (306) in the channel (302), showing a transverse cut (c-c') line.
Figure 38:
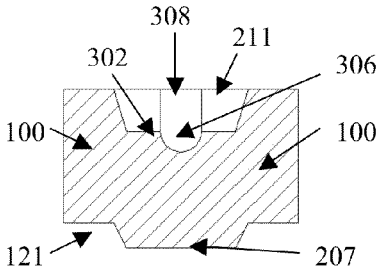
FIG. 38 is a transverse cut (a-a') view of the quoin block (955) for course of ducting blocks (953) with a notch (306) in the channel (302), shown in FIG. 36.
Figure 39:
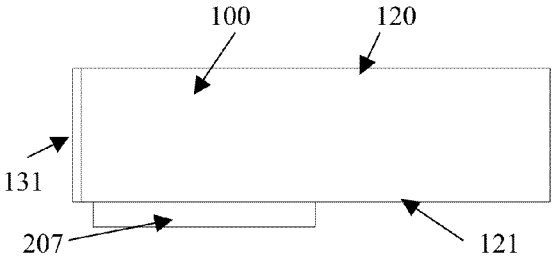
FIG. 39 is a front view of the quoin block (955) for course of ducting blocks (953) with a notch (306) in the channel (302).
Figure 40:
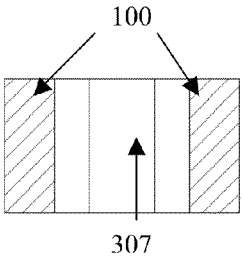
FIG. 40 is a transverse cut (c-c') view of the quoin block (955) for course of ducting blocks (953) with a notch (306) in the channel (302), shown in FIG. 37.
Figure 41:
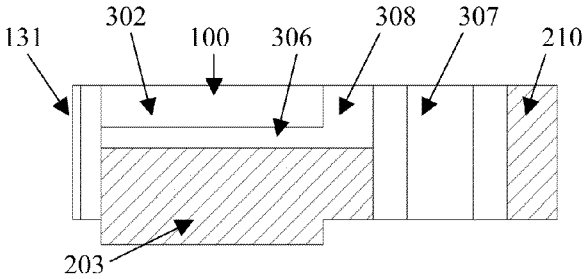
FIG. 41 is a longitudinal cut (b-b') view of the quoin block (955) for course of ducting blocks (953) with a notch (306) in the channel (302), shown in FIG. 36.
Figure 42:
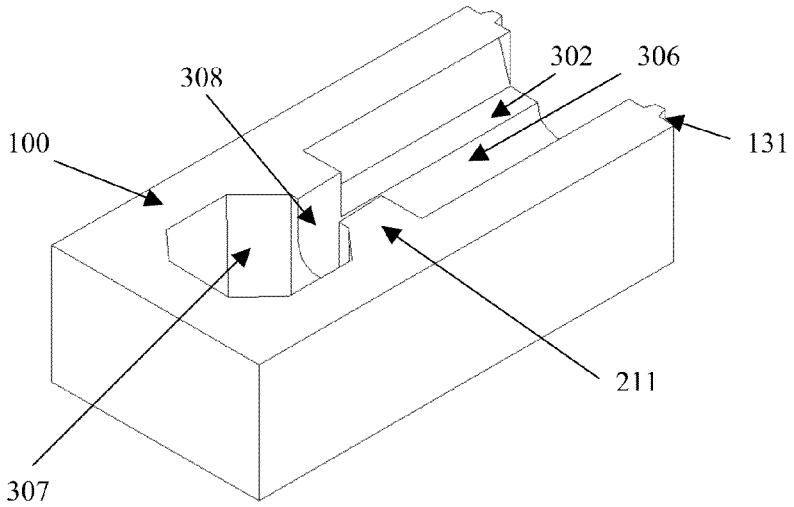
FIG. 42 is an outer top perspective view of the quoin block (955) for course of ducting blocks (953) with a notch (306) in the channel (302).
Figure 43:
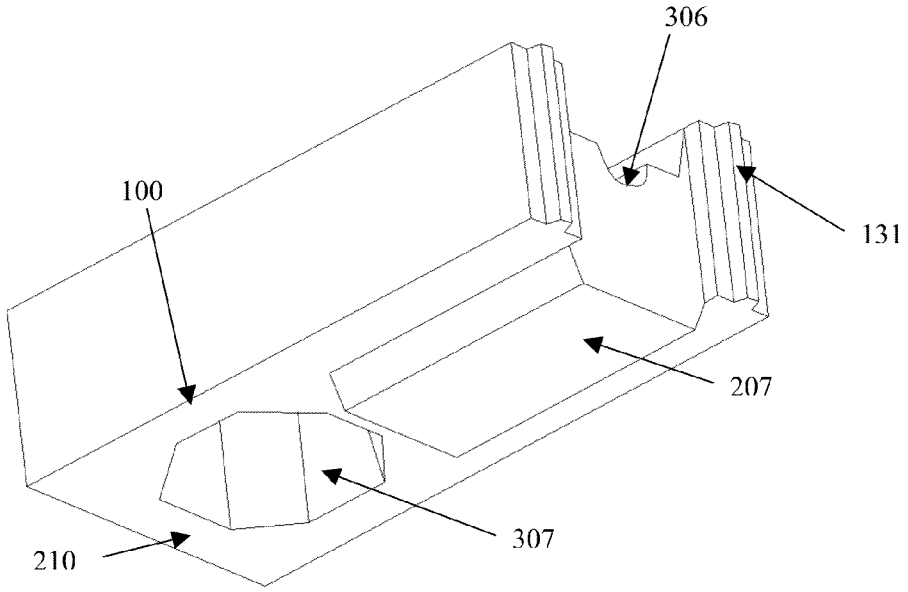
FIG. 43 is a bottom perspective view of the quoin block (955) for course of ducting blocks (953) with a notch (306) in the channel (302).
Figure 44:
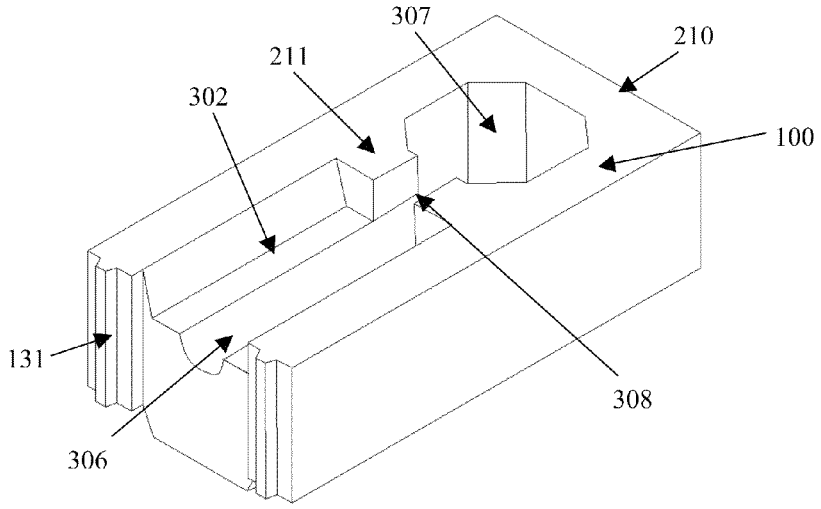
FIG. 44 is an inner top perspective view of the quoin block (955) for course of ducting blocks (953) with a notch (306) in the channel (302).
Figure 45:
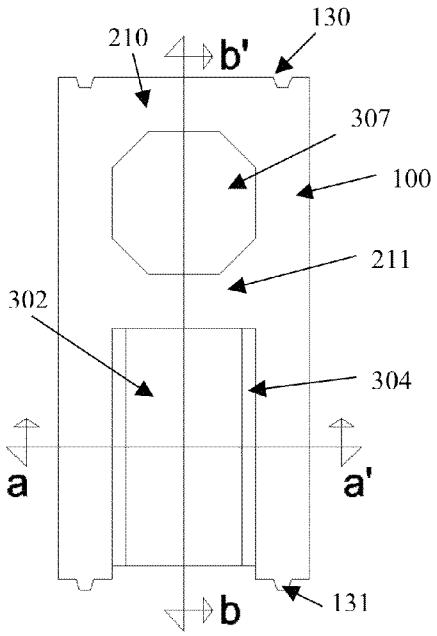
FIG. 45 is a top view of the continuation block (956) for course, showing transverse cut (a-a') and longitudinal cut (b-b') lines.
Figure 46:
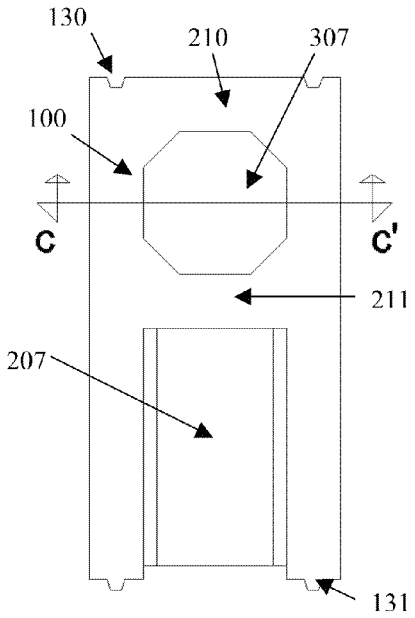
FIG. 46 is a bottom view of the continuation block (956) for course, showing transverse cut (c-c') line.
Figure 47:
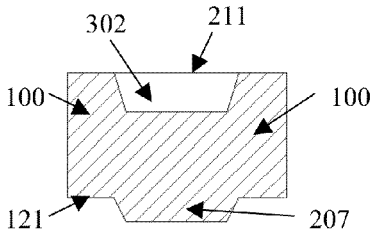
FIG. 47 is a transverse cut (a-a') view of the continuation block (956) for course, shown in FIG. 45.
Figure 48:
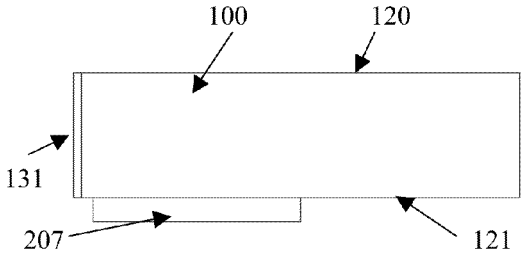
FIG. 48 is a front view of the continuation block (956) for course.
Figure 49:
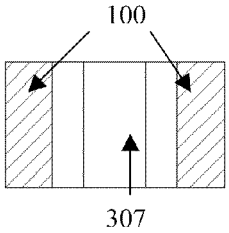
FIG. 49 is a transverse cut (c-c') view of the continuation block (956) for course, shown in FIG. 46.
Figure 50:
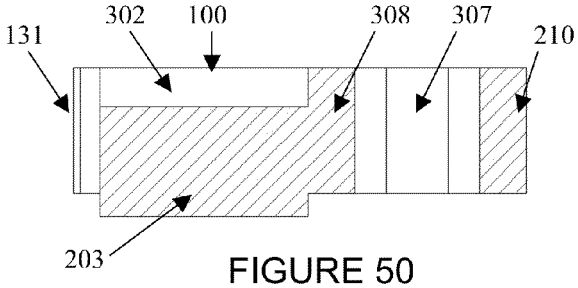
FIG. 50 is a longitudinal cut (b-b') view of the continuation block (956) for course, shown in FIG. 45.
Figure 51:
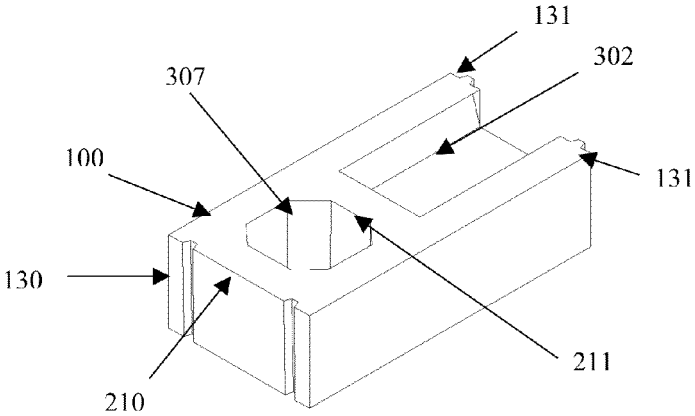
FIG. 51 is an outer top perspective view of the continuation block (956) for course.
Figure 52:
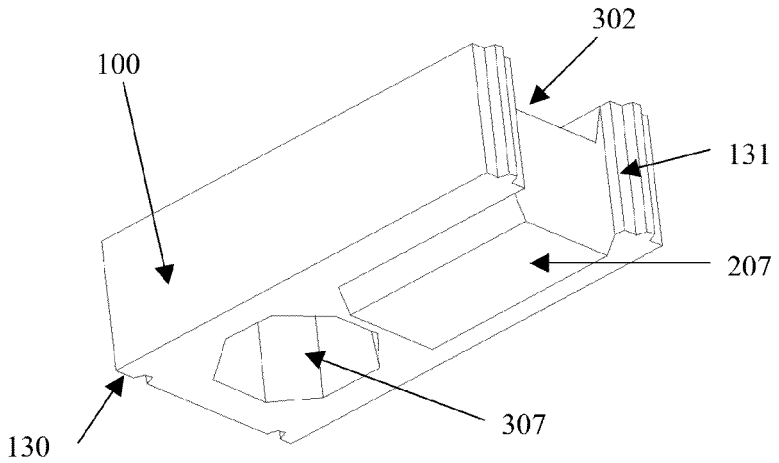
FIG. 52 is a bottom perspective view of the continuation block (956) for course.
Figure 53:
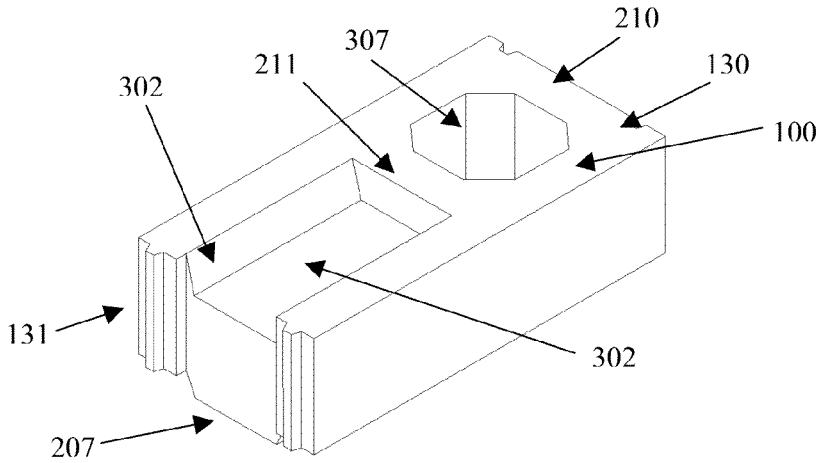
FIG. 53 is an inner top perspective view of the continuation block (956) for course.
Figure 54:
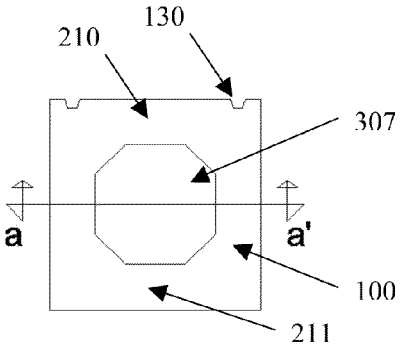
FIG. 54 is a top view of the ending block (952) showing a transverse cut (a-a') line.
Figure 55:
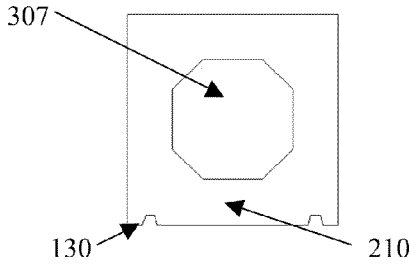
FIG. 55 is a bottom view of the ending block (952).
Figure 56:
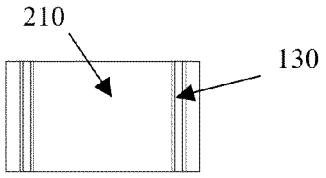
FIG. 56 is a side view of the ending block (952).
Figure 57:
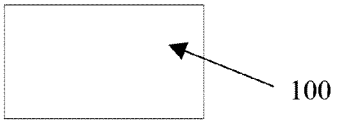
FIG. 57 is a front view of the ending block (952).
Figure 58:
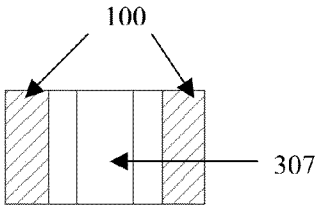
FIG. 58 is a transverse cut (a-a') view of the ending block (952), shown in FIG. 54.
Figure 59:
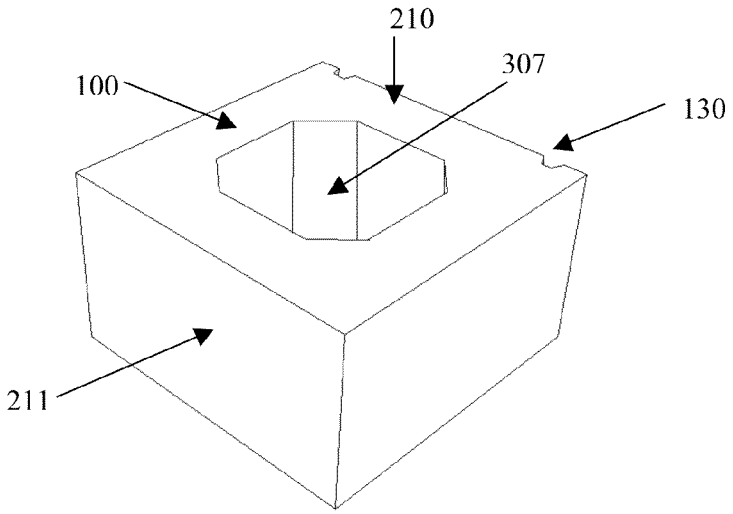
FIG. 59 is an outer top perspective view of the ending block (952).
Figure 60:
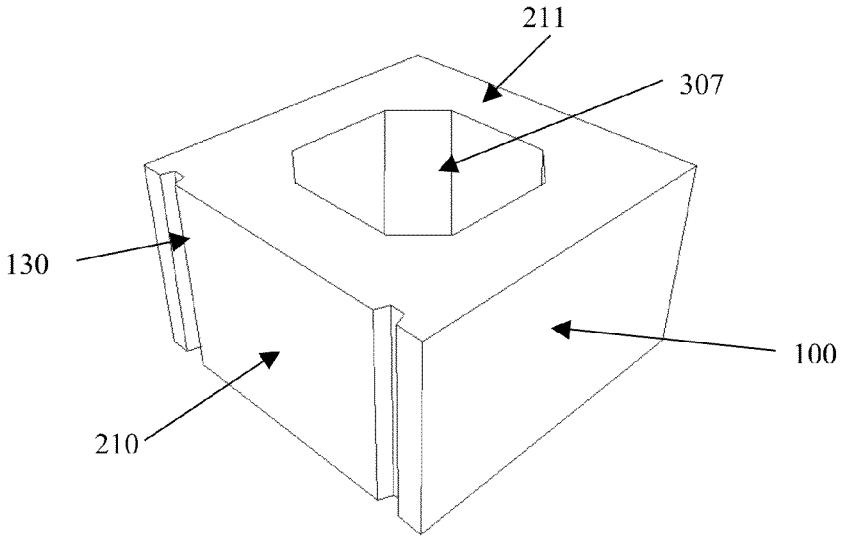
FIG. 60 is an inner top perspective view of the ending block (952).
Figure 61:
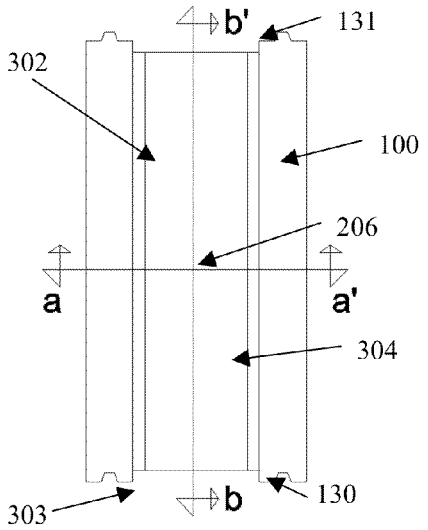
FIG. 61 shows a top view of the lightened block (951) showing transverse cut (a-a') and longitudinal cut (b-b') lines.
Figure 62:
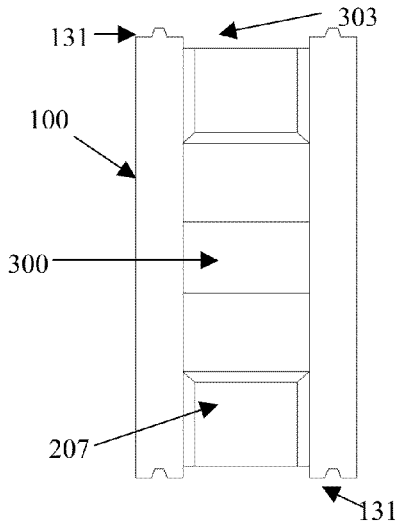
FIG. 62 is a bottom view of the lightened block (951).
Figure 63:
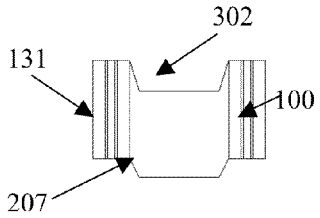
FIG. 63 is a side view of the lightened block (951).
Figure 64:
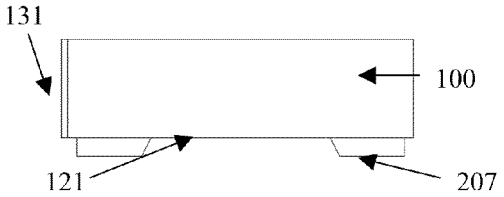
FIG. 64 is a front view of the lightened block (951).
Figure 65:
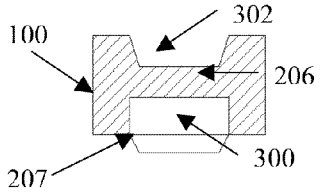
FIG. 65 is a transverse cut (a-a') view of the lightened block (951), shown in FIG. 61.
Figure 66:
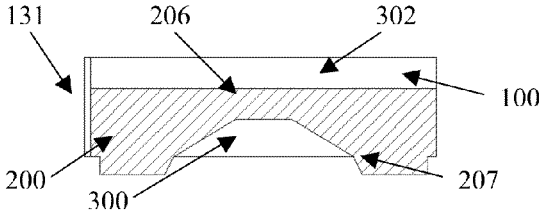
FIG. 66 is a longitudinal cut (b-b') view of the lightened block (951), shown in FIG. 61.
Figure 67:
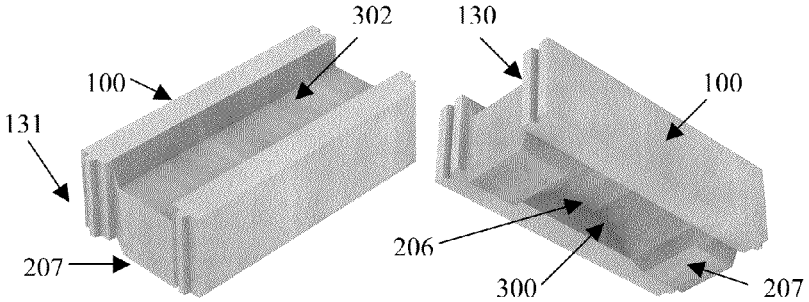
FIG. 67 shows the top and bottom perspective views of the lightened block (951).
Figure 68:
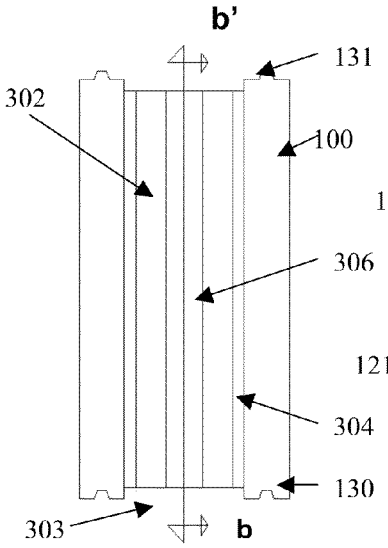
FIG. 68 is a top view of the ducting block (953) with a notch (306) in the channel (302), showing a longitudinal cut (b-b') line.
Figure 69:
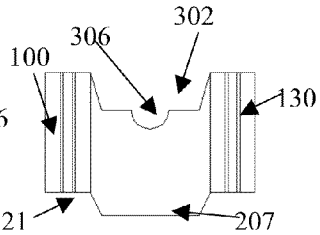
FIG. 69 is a side view of the ducting block (953) with a notch (306) in the channel (302).
Figure 70:
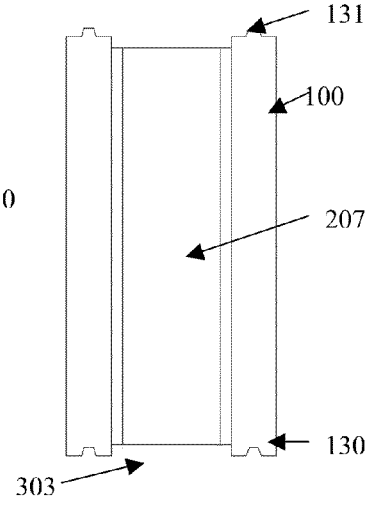
FIG. 70 is a bottom view of the ducting block (953) with a notch (306) in the channel (302).
Figure 71:
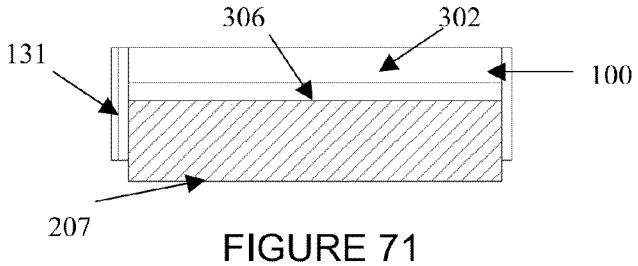
FIG. 71 is a longitudinal cut (b-b') view of the ducting block (953) with a notch (306) in the channel (302), shown in FIG. 68.
Figure 72:
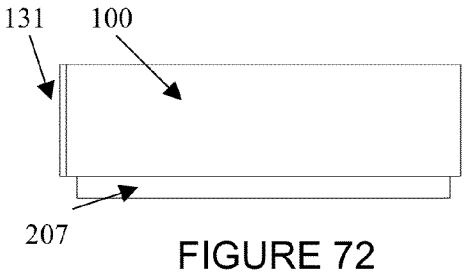
FIG. 72 is a side view of the ducting block (953) with a notch (306) in the channel (302).
Figure 73:
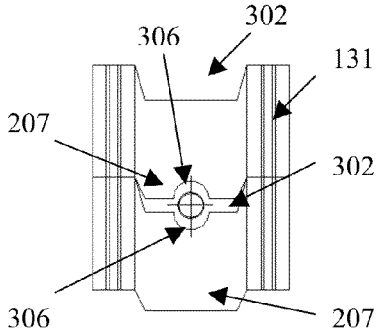
FIG. 73 is a side view of a ducting block (953) with a notch (306) in the base (207), placed on a ducting block (953) with a notch (306) in the channel (302).
Figure 74:
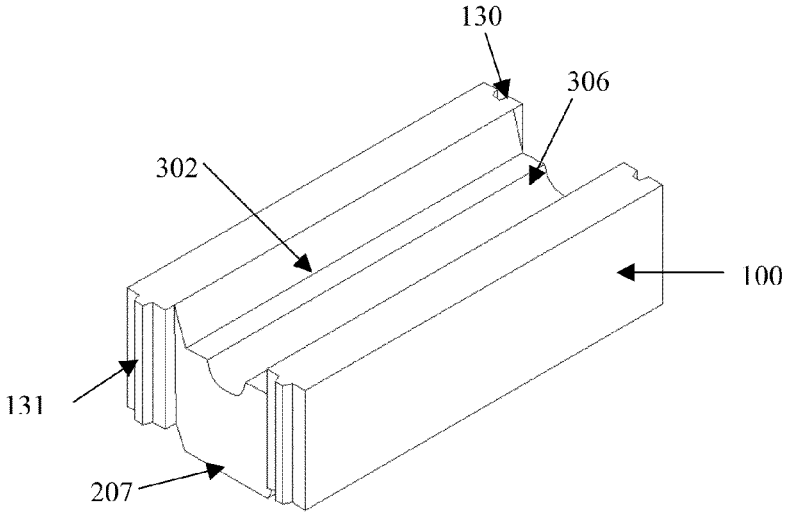
FIG. 74 is a top perspective view of the ducting block (953) with a notch (306) in the channel (302).
Figure 75:
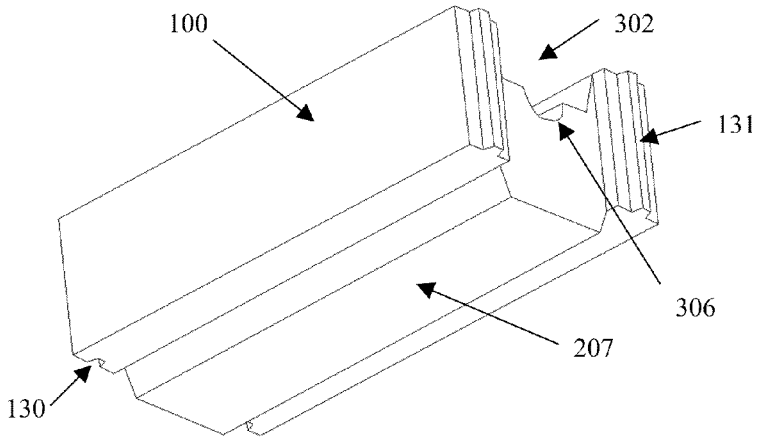
FIG. 75 is a bottom perspective view of the ducting block (953) with a notch (306) in the channel (302).
Figure 76:
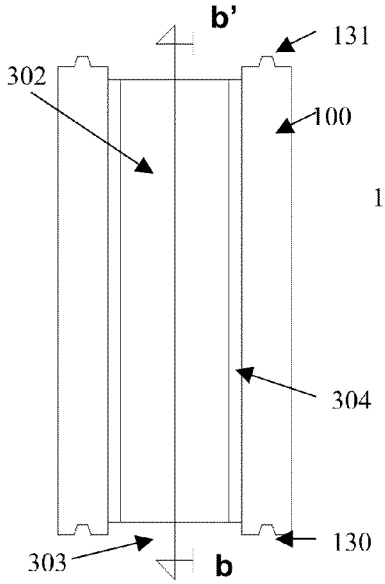
FIG. 76 is a top view of the ducting block (953) with a notch (306) in the base (207) showing a longitudinal cut (b-b') line.
Figure 77:
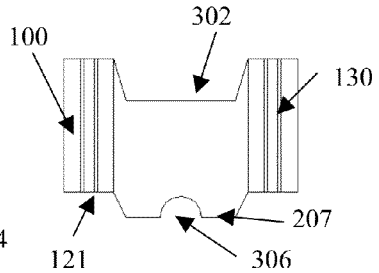
FIG. 77 is a side view of the ducting block (953) with a notch (306) in the base (207).
Figure 78:
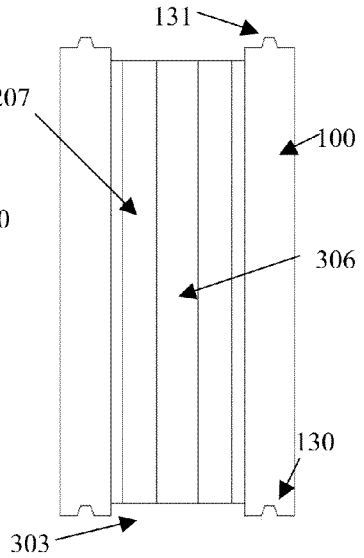
FIG. 78 is a bottom view of the ducting block (953) with a notch (306) in the base (207).
Figure 79:
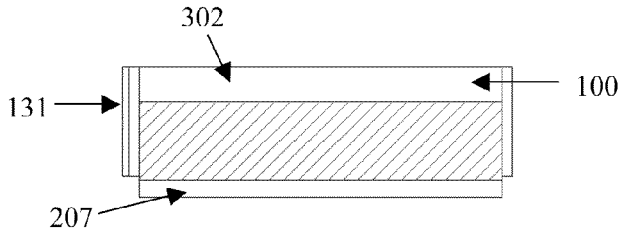
FIG. 79 is a longitudinal cut (b-b') view of the ducting block (953) with a notch (306) in the base (207), shown in FIG. 76.
Figure 80:
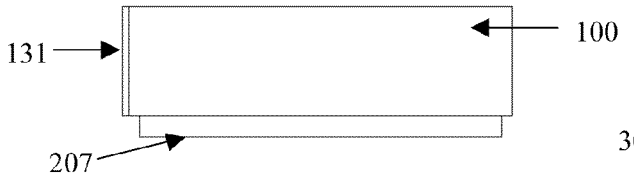
FIG. 80 is a front view of the ducting block (953) with a notch (306) in the base (207).
Figure 81:
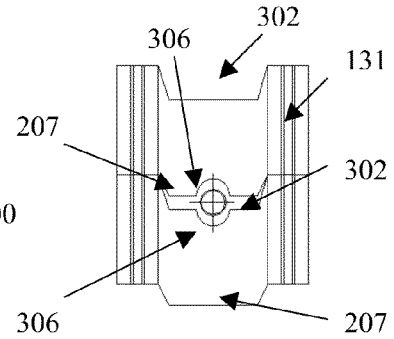
FIG. 81 is a side view of a ducting block (953) with a notch (306) in the base (207), placed on a ducting block (953) with a notch (306) in the channel (207).
Figure 82:
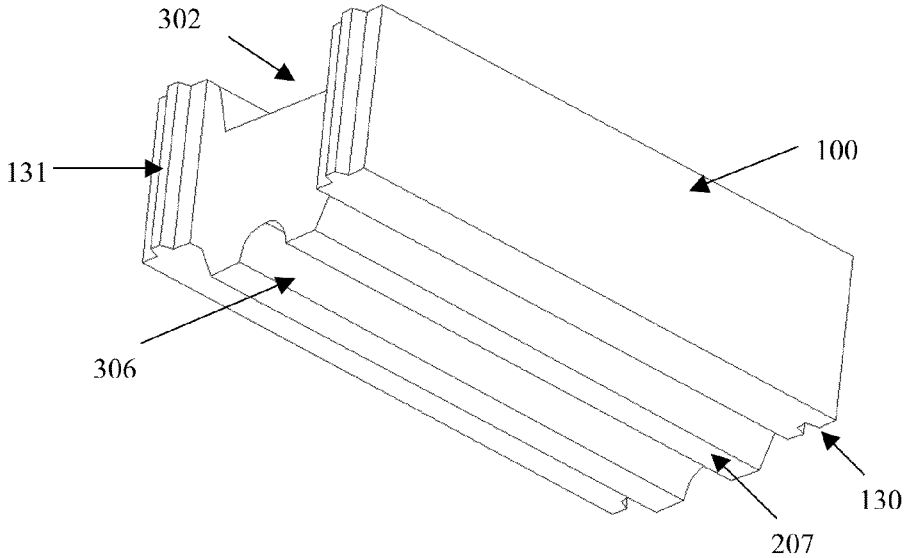
FIG. 82 is a bottom perspective view of the ducting block (953) with a notch (306) in the base (207).
Figure 83:
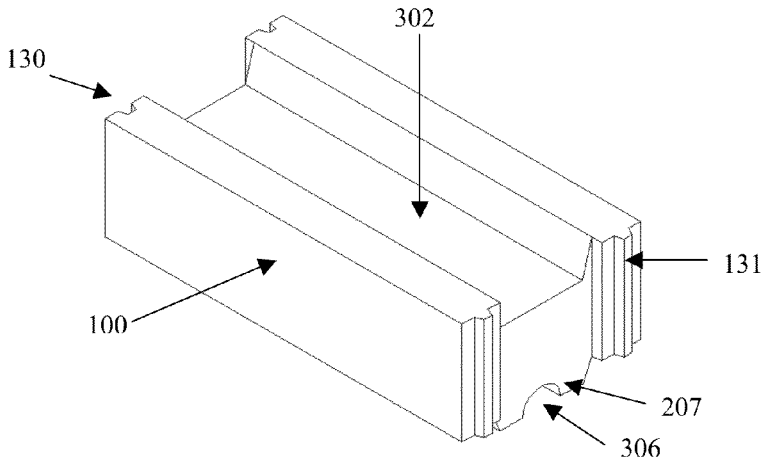
FIG. 83 is a top perspective view of the ducting block (953) with a notch (306) in the base (207).
Figure 84:
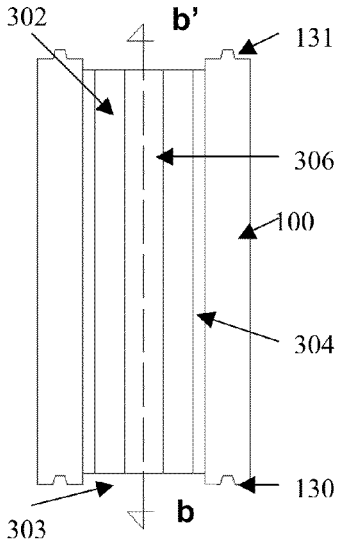
FIG. 84 is a top view of the ducting block (953) with notches (306) both in the channel (302) and in the base (207) showing a longitudinal cut (b-b') line.
Figure 85:
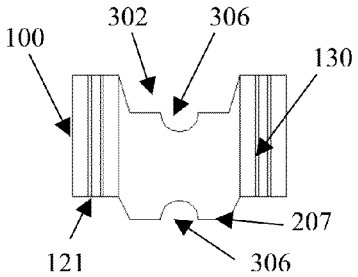
FIG. 85 is a side view of the ducting block (953) with notches (306) both in the channel (302) and in the base (207).
Figure 86:
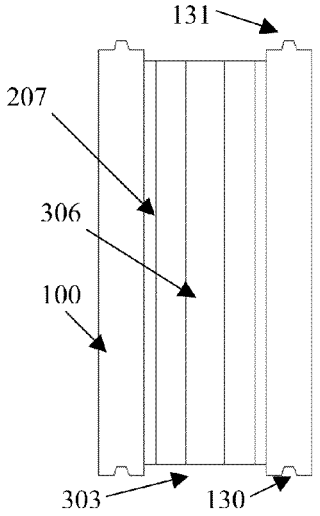
FIG. 86 is a bottom view of the ducting block (953) with notches (306) both in the channel (302) and in the base (207).
Figure 87:
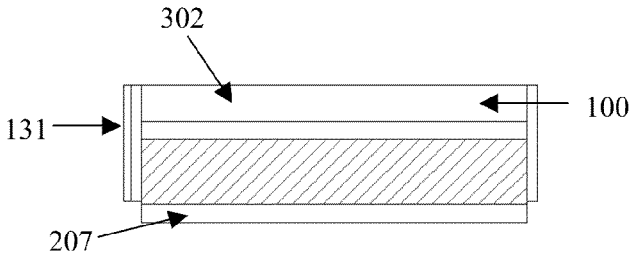
FIG. 87 is a longitudinal cut (b-b') view of the ducting block (953) with notches (306) both in the channel (302) and in the base (207).
Figure 88:
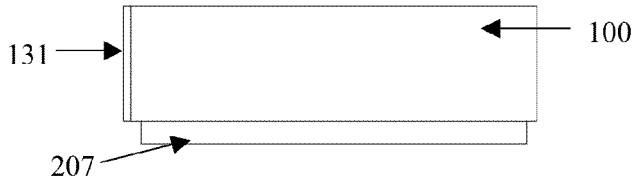
FIG. 88 is a front view of the ducting block (953) with notches (306) both in the channel (302) and in the base (207).
Figure 89:
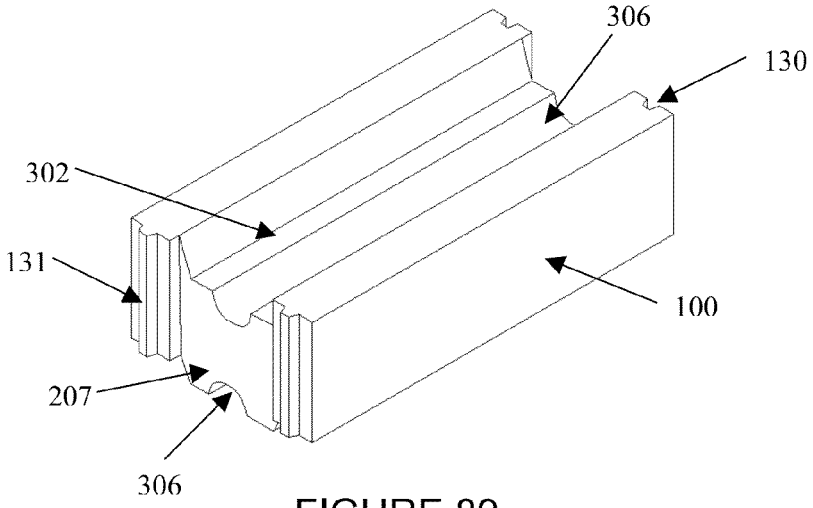
FIG. 89 is a top perspective view of the ducting block (953) with notches (306) both in the channel (302) and in the base (207).
Figure 90:
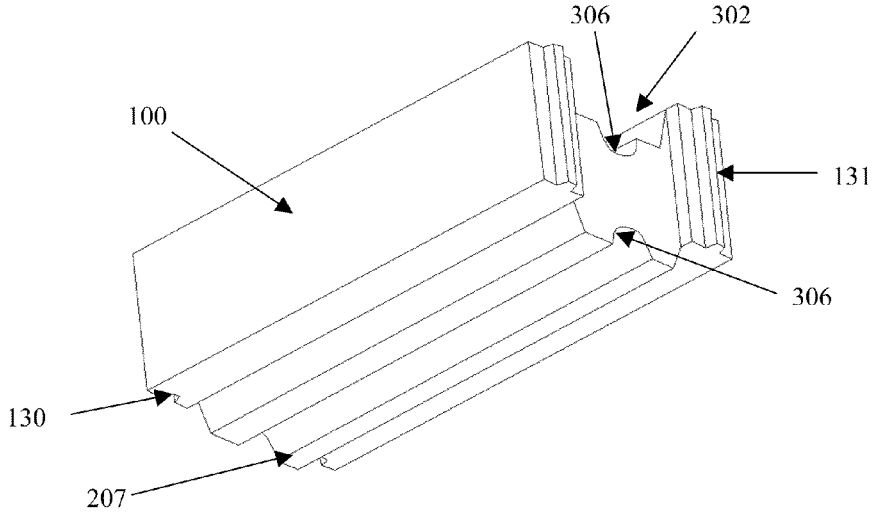
FIG. 90 is a bottom perspective view of the ducting block (953) with notches (306) both in the channel (302) and in the base (207).
Figure 91:
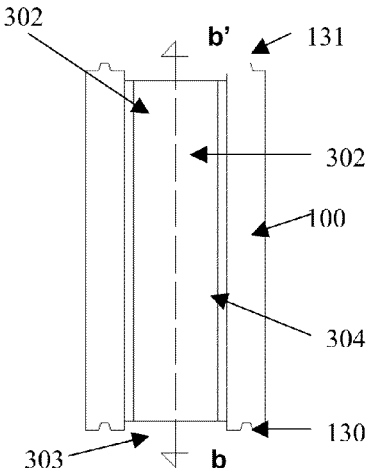
FIG. 91 is a top view of the reinforcement block (954) with a longitudinal cut (b-b') line.
Figure 92:
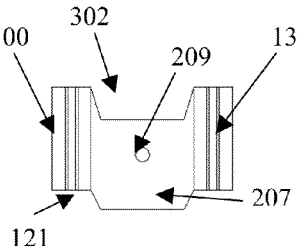
FIG. 92 is a side view of the reinforcement block (954).
Figure 93:
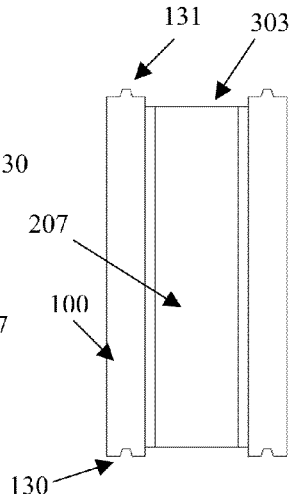
FIG. 93 is a bottom view of the reinforcement block (954).
Figure 94:
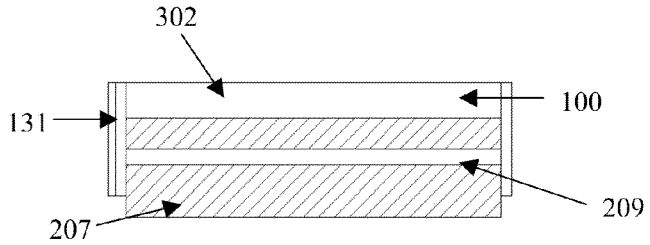
FIG. 94 is a longitudinal cut (b-b') view of the reinforcement block (954).
Figure 95:
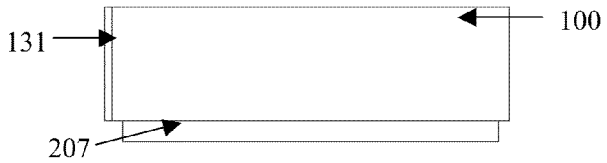
FIG. 95 is a front view of the reinforcement block (954).
Figure 96:
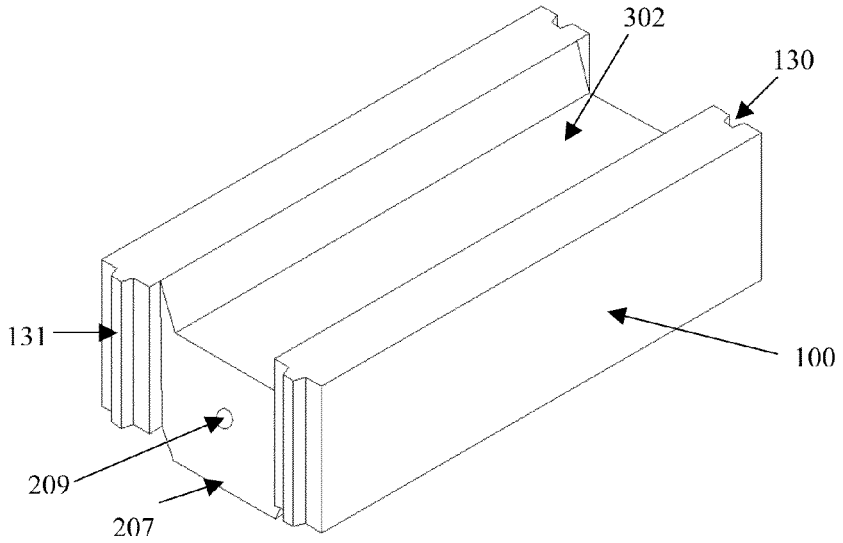
FIG. 96 is a top perspective view of the reinforcement block (954).
Figure 97:
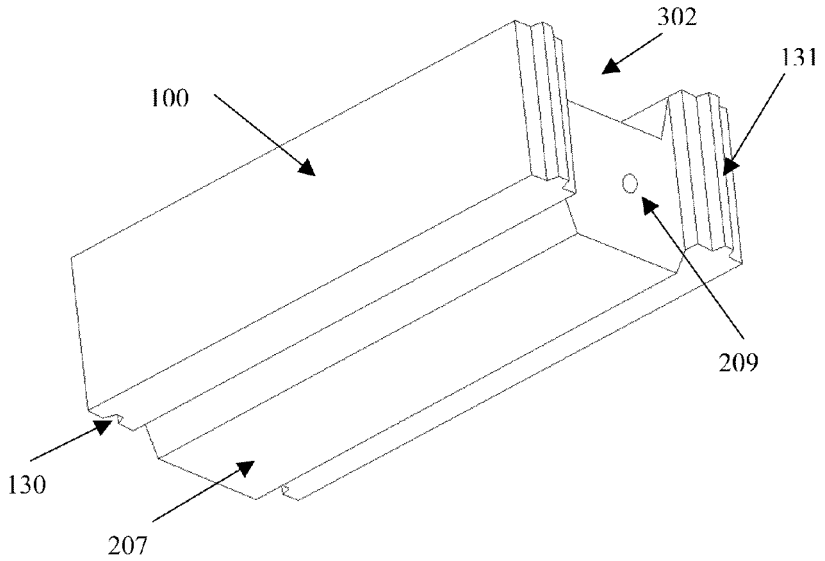
FIG. 97 is a bottom perspective view of the reinforcement block (954).
Figure 98:
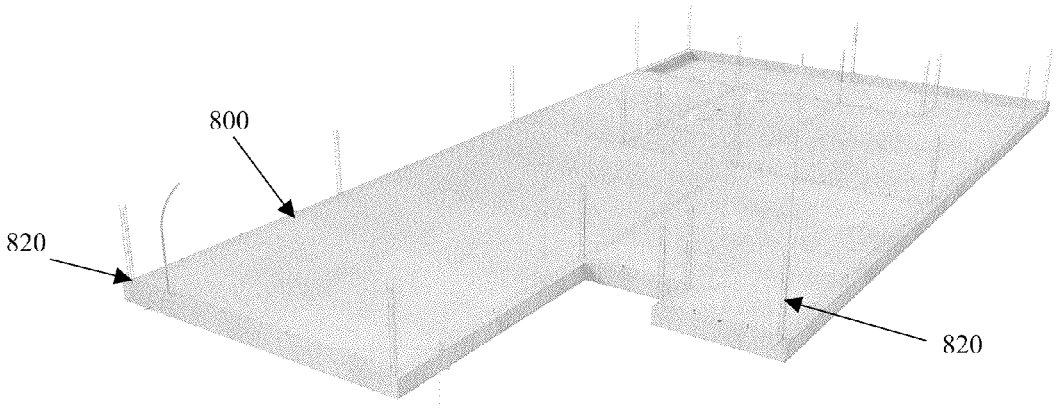
FIG. 98 shows a plinth surface (800) with piers (820).
Figure 99:
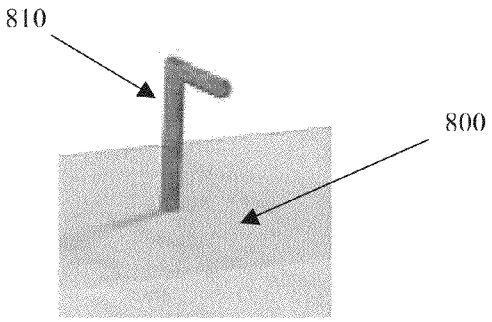
FIG. 99 shows a section of the plinth surface (800) above with sewage installations and fixings (810).
Figure 100:
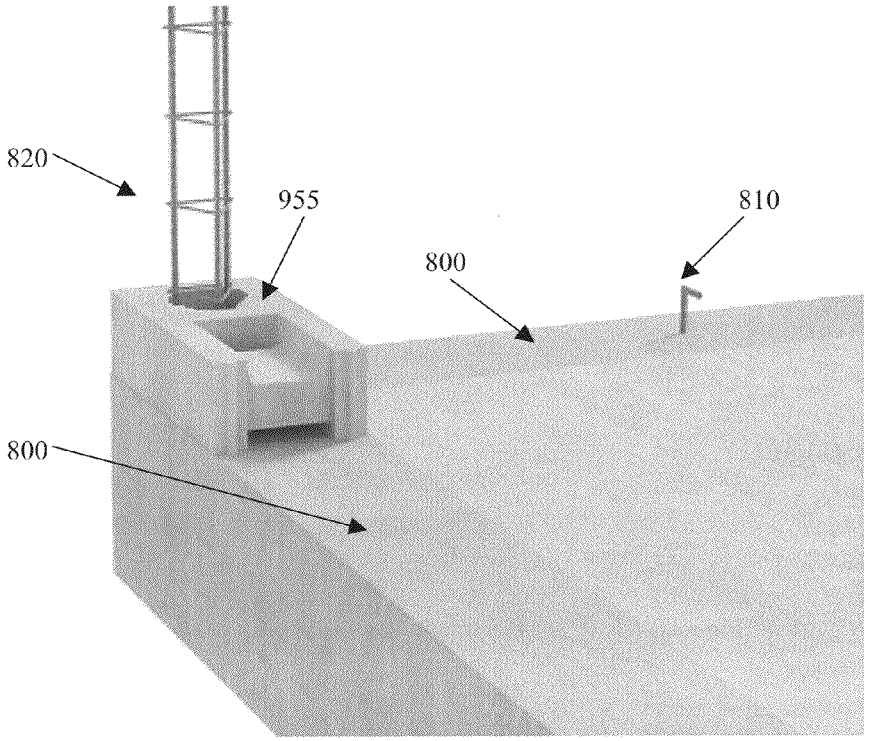
FIG. 100 shows a fixing (810) anchored in the plinth surface (800).
Figure 101:
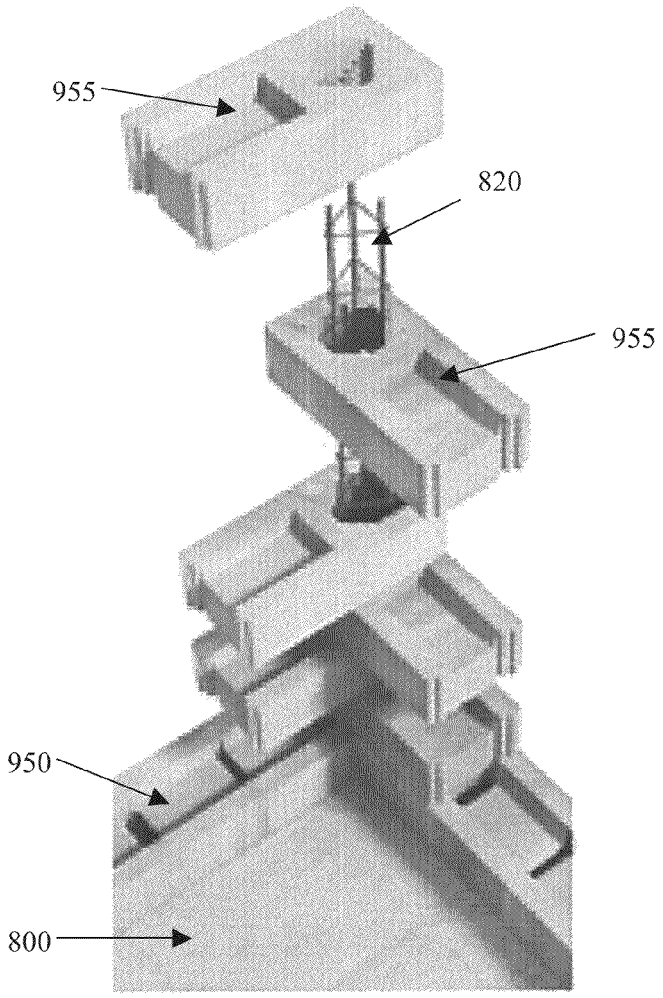
FIG. 101 shows a plinth surface (800) perfectly leveled, a pier (820), a quoin block (955) coupled to said pier (820) and plinth surface (800), and a fixing (810).
Figure 102:
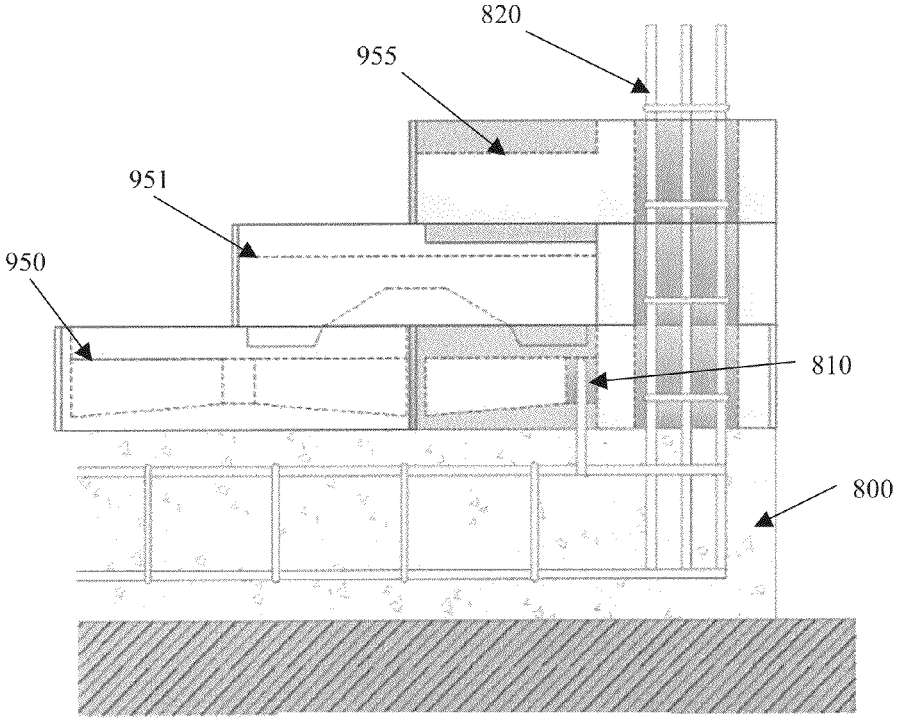
FIG. 102 shows an interior wall corner with two plinth courses at 90° and a pier (820) on a plinth surface (800) and a plurality of quoin blocks (955) placed around said pier (820), one on top of another, alternating their orientation by 90°, forming an apparent finish in the wall being constructed.
Figure 103:
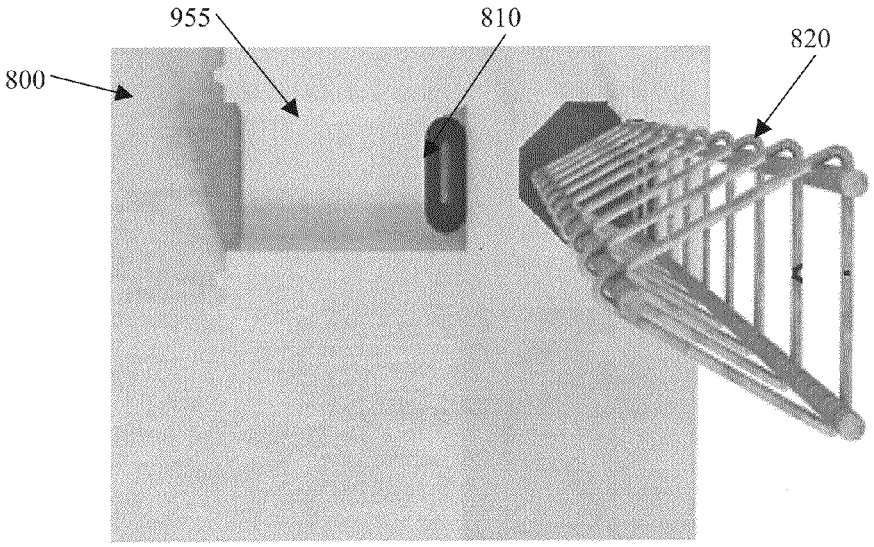
FIG. 103 shows a section of three courses of a wall constructed with blocks equipped with coupling means, its plinth surface (800), pier (820) and fixing (810).
Figure 104:
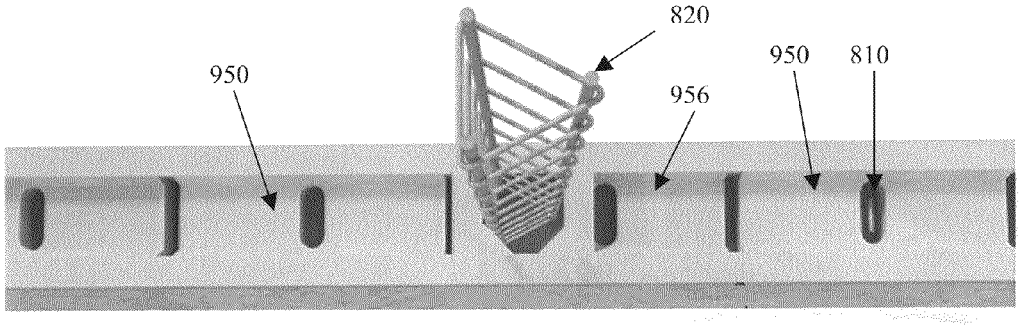
FIG. 104 shows a top perspective view of a plinth surface (800) corner with a pier (820), a quoin block (955) for plinth course coupled on said pier (820) and on a fixing (810), which crosses the cavity (204) of the block.
Figure 105:
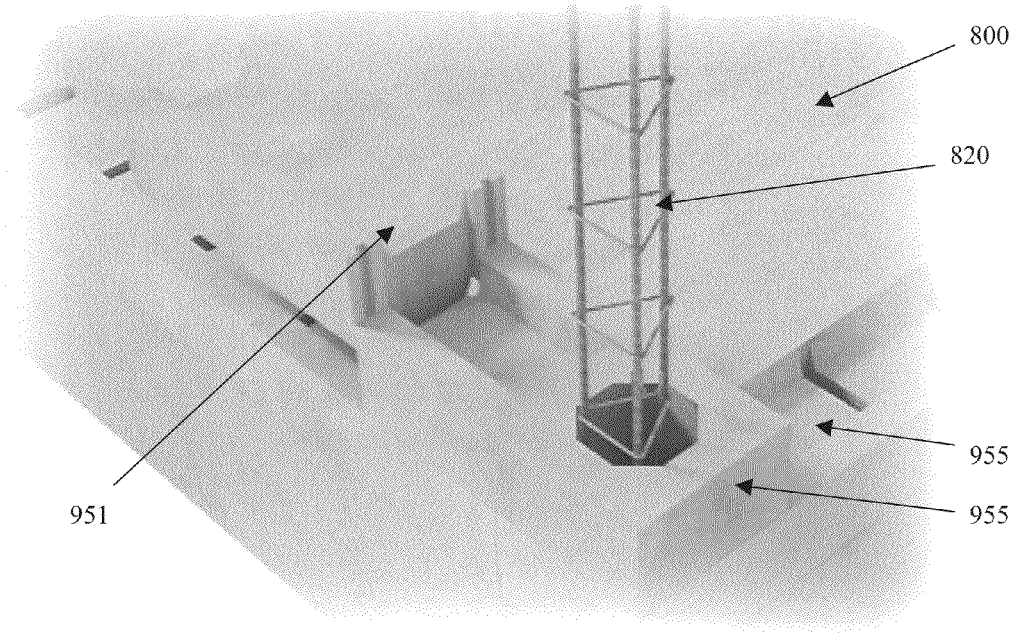
FIG. 105 shows a top perspective view of a plinth course with intermediate pier (820) and its corresponding continuation block (956) for plinth course.
Figure 106:
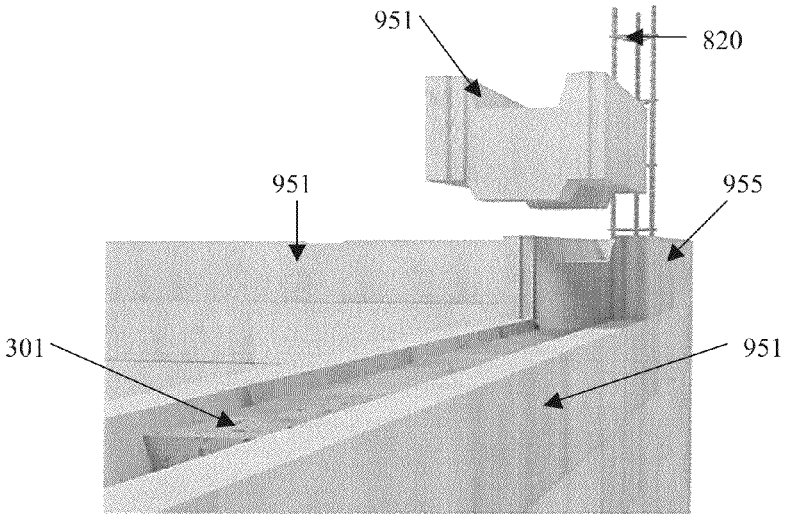
FIG. 106 shows an outside corner wall with a pier (820) a lightened block (951) coupled to a quoin block (955).
Figure 107:
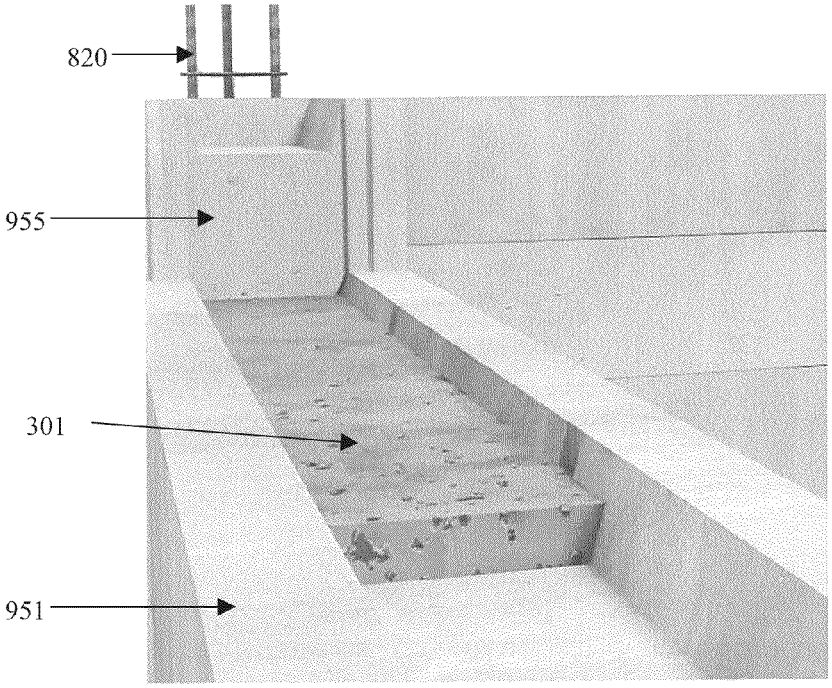
FIG. 107 shows a side perspective view of one course in which a lightened block from the course above is being placed on the adhesive (301) disposed in the channel (302) of formerly said course.
Figure 108:
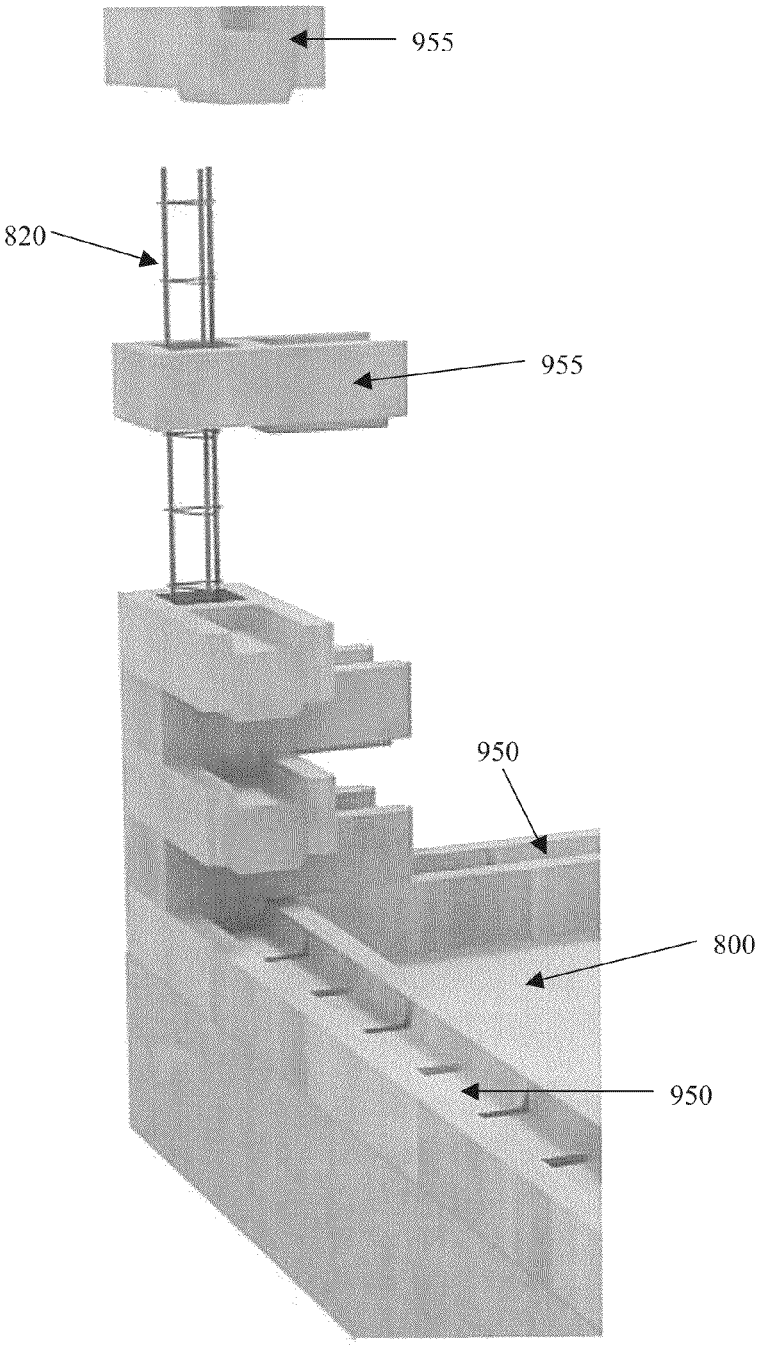
FIG. 108 shows the adhesive disposed on the channel (302) of a course.
Figure 109:
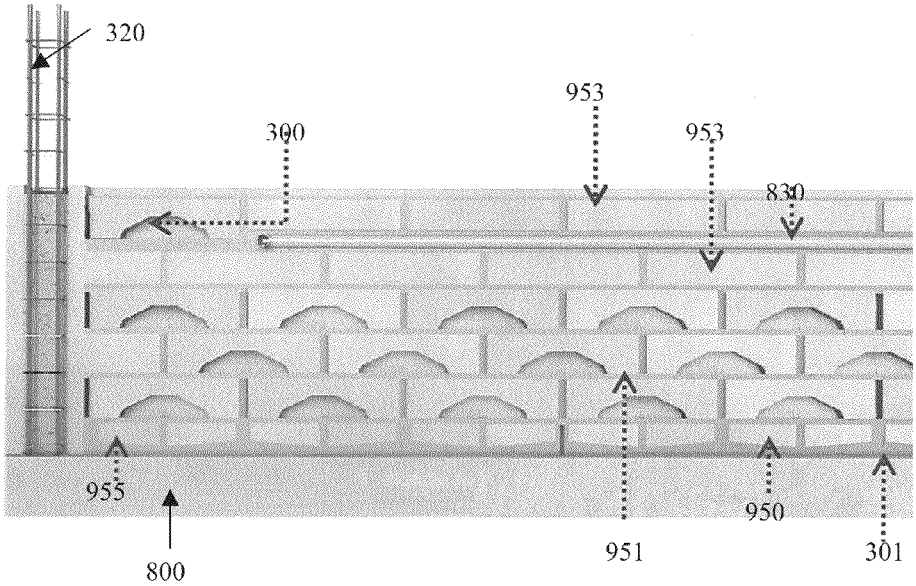
FIG. 109 shows a side perspective view of a wall corner, showing the plinth surface (800), the plinth blocks course, a pier (820) and the placement of a plurality of quoin blocks (955), alternating their orientation around said pier (820).
Figure 110:
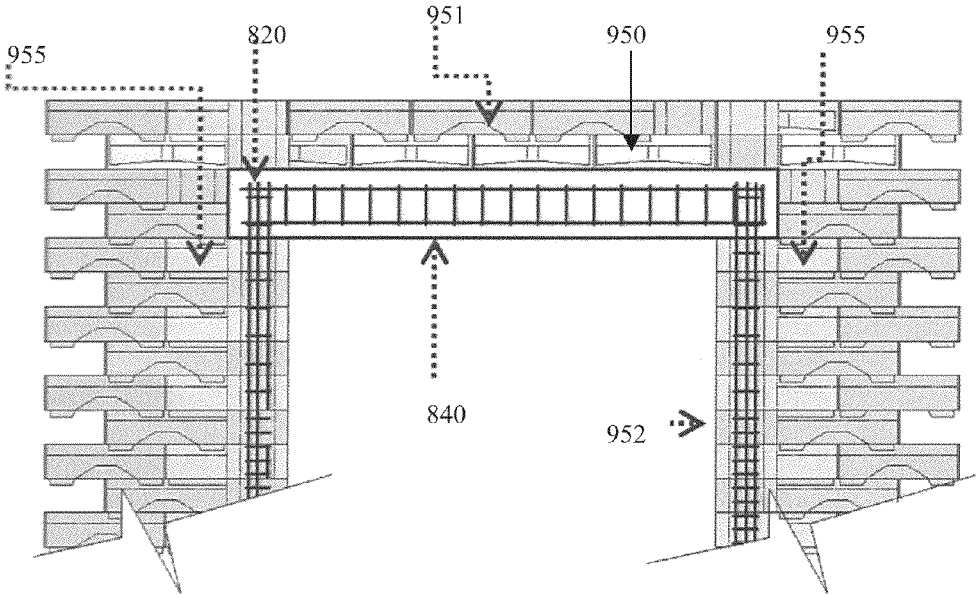
FIG. 110 shows a front view of a wall built with blocks equipped with coupling means.
Figure 111:
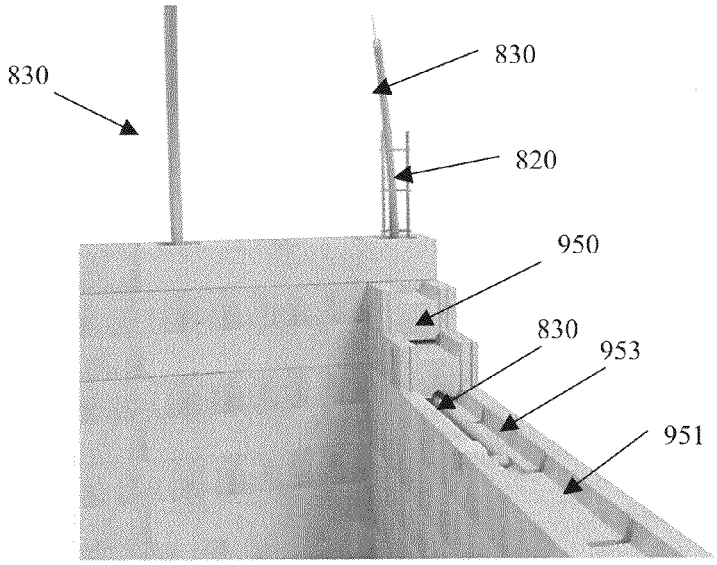
FIG. 111 shows a wall with piers (820) and wall beams (840) for windows or doors built with blocks equipped with coupling means.
Figure 112:
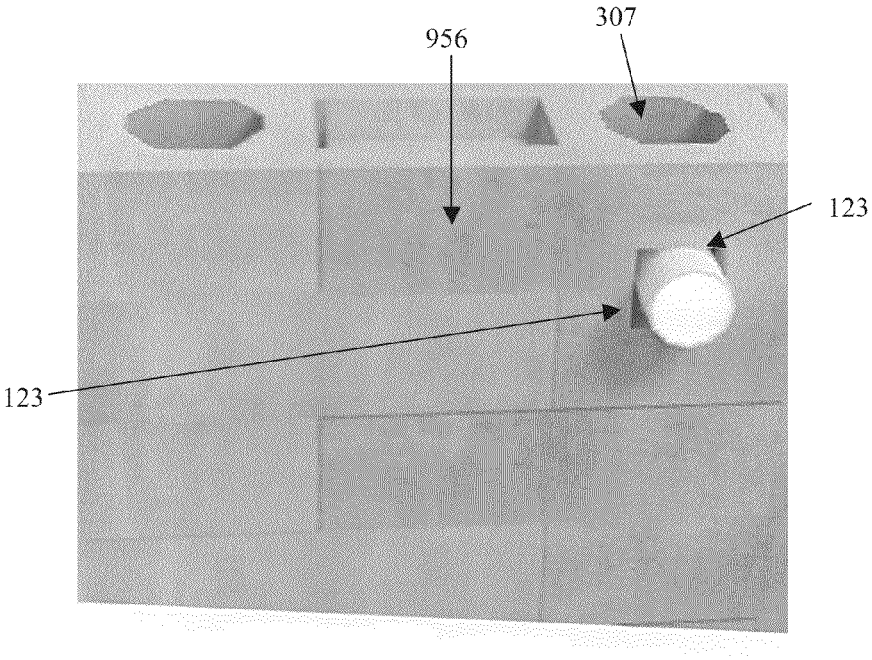
FIG. 112 shows the inner corner of a wall wherein the ducting course can be seen.
Figure 113:
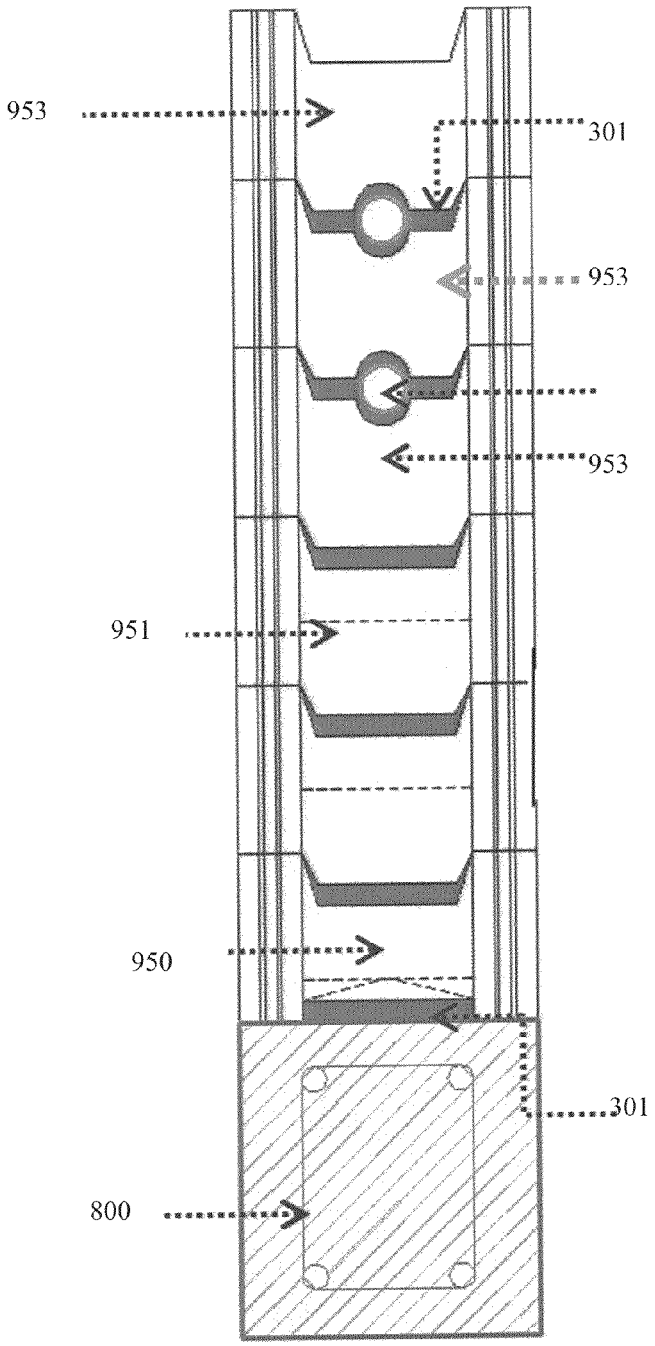
FIG. 113 shows a wall comprising continuation blocks (956) in which a vertical pipe is installed through the vertical tunnel (307), said pipe ending with an elbow joint protruding from the wall through an opening (123) in the walls of the vertical tunnel (307) in the continuation block (956), at the desired height.
Figure 114:
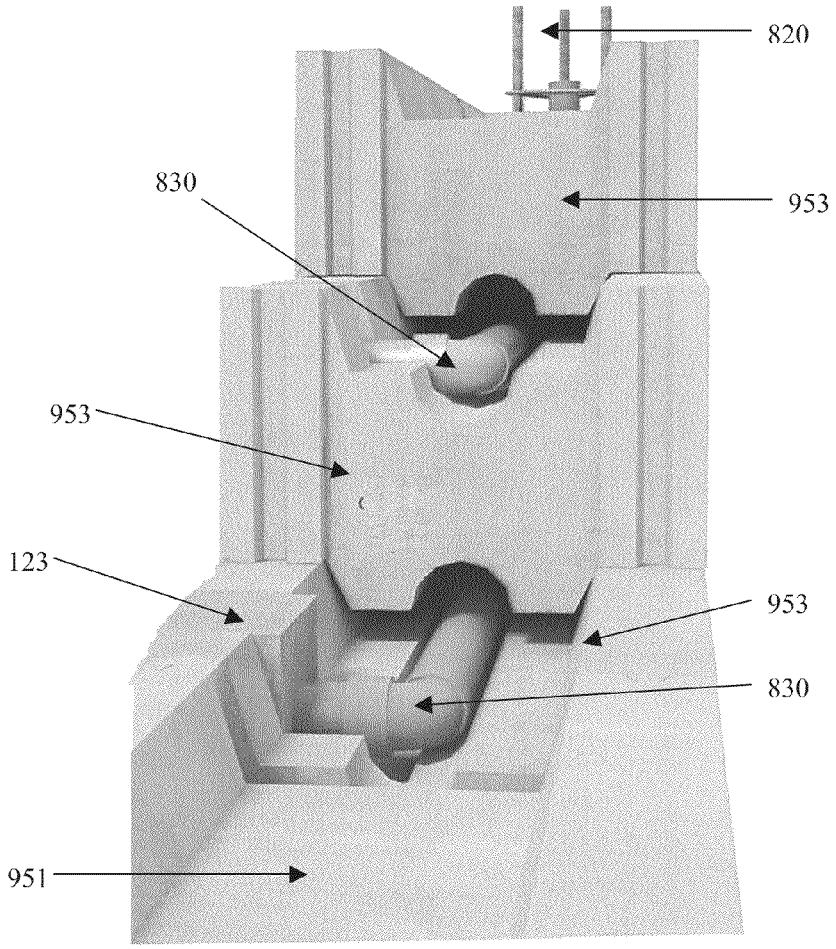
FIG. 114 is a transverse cut of a wall built with blocks equipped with coupling means.

The present invention consists of a wall construction system comprising a set of blocks equipped with coupling means, having some features common to all of these and other features that complement each other, and a wall building method using said blocks equipped with coupling means.

The blocks equipped with coupling means may be made of lightweight concrete or plastic or other man-made material. Preferably, the body of the block equipped with coupling means is made of cast material, extruded material or natural stone. The cast material is selected from the group comprising concrete, clay, mud, adobe, foamed concrete, reconstituted stone or sand, polymers, recycled materials, or a combination thereof.

The first type of block equipped with coupling means is called plinth block (950), which consists of four elements. Two of said elements are rectangular prisms (100), being parallel to each other. Their front faces (101) correspond to the inner and outer sides, respectively, of the wall being built. Said front faces (101) are proportionately greater in area than its top, bottom and sides, which form its upper edge (120), lower edge (121) and side edges (122) respectively. Said rectangular prisms (100) form the inner and outer sides of the wall being built with the blocks equipped with coupling means. For the plinth block (950), said rectangular prisms (100) are separated by two trapezoidal prisms (200) whose cross section is a rectangular trapezoid (201), this being its profile, with the face of said trapezoidal prism (200) corresponding to the angled side (202) of the rectangular trapezoid (201) profile facing downwards. Trapezoidal prisms (200) are arranged opposite to each other on one of their faces, said faces corresponding to the minor base (203) of the rectangular trapezoid (202) profile of each trapezoidal prism (200). Between said faces there is a cavity (204). In the central part of the bottom surface of the plinth block (950), corresponding to the lower faces of the trapezoidal prisms (200), two slopes (205) are formed, at an angle that opens and rises from the ends of the plinth block (950) towards its center, where the cavity (204) is, said slopes (205) not crossing with the top surfaces of the trapezoidal prisms (200). The lowest point of the slopes (205) is elevated relative to the lower edge (121) of the two rectangular prisms (100), so that when placing the plinth block (950) on the plinth surface (800), the lower edge (121) of the two rectangular prisms (100) is laid directly on said plinth surface (800) without any intermediate space but leaving a space between said plinth surface (800) and the surface of the slopes (205). Thereby forming a cavity (300) between the plinth surface and the slopes (205) where the adhesive (301) will be accommodated.

Rectangular trapezoid (201) surfaces corresponding to the profile of the trapezoidal prisms (200) being the central part of the plinth block (950) are attached to the rectangular prisms (100). The upper edge (120) of both trapezoidal prisms (200) is elevated relative to the top surfaces of said trapezoidal prisms (200), which correspond to the perpendicular side of the rectangular trapezoid (201) profile. This forms a channel (302) on the top of the plinth block (950) with a cavity (204) in the center of said plinth block (950). The side surface of the trapezoidal prisms (200), opposite to the cavity (204) is recessed relative to the side edges (122) of both rectangular prisms (100), forming a vertical cavity (303). When placing two adjacent plinth blocks (950), said vertical cavity (303) serves to accommodate adhesive (301) and thereby sticking both plinth blocks (950). All visible surfaces of the trapezoidal prisms (200) have a roughened or textured finish, as they will come into contact with the adhesive (301). The side surfaces of the rectangular prisms (100) corresponding to the walls (304) of the channel (302) have an inclination (305) preferably between 5° and 45°, beginning from the border of the upper edge (120) of each trapezoidal prism (200) and opening towards the center of the plinth block (950).

Placement of the plinth block (950) on the plinth surface (800) is done before applying the adhesive (301). Once the course is placed, the adhesive is poured through the cavities (204) to get them filled and therefore sticking the plinth blocks (950) to the plinth surface (800). The plinth surface (800) may have a plurality of fixings (810) protruding from the plinth surface (800) in order to place plinth blocks (950) on said fixings (810) so that they are inserted into the cavity (204) of the plinth blocks (950), to provide greater strength to the wall, particularly in seismic zones. In one of its embodiments, the plinth block (950) has a groove (130) disposed vertically on one of the side edges (122) of each of the rectangular prisms (100), preferably centrally placed on said side edges (122), while its opposite side edge (122) has a ridge (131) disposed vertically, oriented correspondingly with the orientation of the groove (130) in the former side edge (122), so that by placing a plurality of adjacent plinth blocks (950), the ridges (131) of the rectangular prisms (100) from one plinth block (950) fit in the grooves (130) of the rectangular prisms (100) from the adjacent plinth block (950).

The second type of block equipped with coupling means is called lightened block (951). Said lightened block (951) is similar to the plinth block (950), except for the following differences that characterize said lightened block (951): a) both trapezoidal prisms (200) are joined at the center of lightened block (951) by a bridge (206), removing the cavity (204) from the plinth block (950) forming a channel (302) without a cavity (204) in the center of the lightened block (951), b) each one of the trapezoidal prisms (200) has, on the bottom side and near the ends of the lightened block (951), a base (207) whose lower surface (208) is horizontal and protruding relative to the lower edge (121) of the rectangular prisms (100). The height of the protrusion forming said base (207), is less than the height of the walls (304) of the channel (302) on the top face of all kinds of blocks equipped with coupling means of the present invention, except for the ending block (952), which has no channel (302) whatsoever, c) the slope (205) of the trapezoidal prisms (200) is steeper for the lightened block (951) than for the plinth block (950), starting from the bottom base of the bridge (206) towards the lower edge (121) of the rectangular prisms (100), thereby forming the cavity (300).

The protruding bases (207) allow the lightened block (951) to be placed on a previous course of plinth blocks (950), or on a previous course of lightened blocks (951), or a previous course of a combination of any of the blocks equipped with coupling means except for the ending block (952), while automatically aligning itself with said previous course. Prior to its placement, it is necessary to fill the channel (302) of said previous course with adhesive (301). By placing the lightened block (951), the bases (207) displace the adhesive (301) horizontally on the channel (302), distributing it along the cavity (300).

The side faces of the bases (207) placed adjacent to the channel (302) walls of the blocks equipped with coupling means from a previous course, have an inclination from the lower edge (121) of the rectangular prisms (100) and towards the center, wherein said inclination is equal to the inclination of the walls (304) of the channel (302) allowing the blocks equipped with coupling means from one course to fit in the channel (302) of the blocks equipped with coupling means from the course immediately below.

In another embodiment of the lightened block (951), cavity (300) is not present so that the base (207) is unique and extends longitudinally along the bottom of the block equipped with coupling means, having the block (957) a uniform profile.

A third embodiment of the block equipped with coupling means is called ducting block (953). This block equipped with coupling means is similar to the lightened block (951), except that the base (207) is unique to each ducting block (953) extending from end to end thereof.

In a first embodiment of said ducting block (953), the channel (302) has a longitudinal notch (306), preferably through its center, its cross section being preferably semicircular, crossing through the channel (302) from one end of the ducting block (953) to the opposite end, denominated ducting block (953) with a notch in the channel (302).

In a second embodiment of the ducting block (953), the base (207) has a longitudinal notch (306), preferably in its center, its cross section being preferably semicircular, crossing through the base (207) from one end of the ducting block to the opposite end, denominated ducting block (953) with a notch (306) in the base (207).

In a third embodiment of the ducting block (953), the channel (302) has a longitudinal notch (306), preferably in its center, its cross section being preferably semicircular, crossing through the channel (302) from one end of said ducting block to the opposite end and the base (207) has a longitudinal notch (306), preferably in its center, its cross section being preferably semicircular, crossing through the base (207) from one end of the ducting block to the opposite end, denominated ducting block (953) with notches (306) both in the channel (302) and in the base (207).

Said ducting block (953) in its various embodiments allows inserting pipes between a pair of course, at the time of building the wall, avoiding the process of cracking the wall once it is finished to make room for ducting.

A fourth embodiment of the block equipped with coupling means is the reinforcement block (954) which is similar to the ducting block (953), except that it does not have a notch (306) neither in the channel (302) nor in the base (207), but has a longitudinal perforation (209) instead, crossing through the reinforcement block (954) from side to side through its central portion. This reinforcement block (954) is used to structurally reinforce the wall. By laying one or more courses of reinforcement blocks (954), a post-tension cable or a rebar can be installed to horizontally join the piers (820) or columns.

A fifth embodiment of the block equipped with coupling means is called the quoin block (955), which is similar to any of the blocks equipped with coupling means, since their characteristics are complementary to those of any of the previously described blocks equipped with coupling means, substituting one end section of the block equipped with coupling means for the following features: in said end section, the quoin block (955) has a vertical tunnel (307) crossing the quoin block (955) from top to bottom. The vertical tunnel (307) preferably has an octagonal profile, to provide it with strength and it is surrounded by four walls. Two of these walls are formed by the rectangular prisms (100). A third wall corresponds to the outer wall (210) of the quoin block (955) so that said outer wall (210), together with the side edge (122) of both rectangular prisms (100) correspond to one of the sides of the quoin block (955) altogether. In this embodiment, the side edges (122) of the rectangular prisms (100) have neither a ridge (131) nor a groove (130), so that the outer wall (210) is completely smooth on its outer side to achieve the same apparent finish that the visible faces of the rectangular prisms (100) have. An intermediate wall (211) stands in the way between the vertical tunnel (307) and the rest of the block equipped with coupling means. Thus, the quoin block (955) has neither bottom bases (207) nor upper channels (302) in the section corresponding to said vertical tunnel (307), a section that is bounded by said rectangular prisms (100), said outer wall (210) and said intermediate wall (211). Said quoin block (955) allows to finish the wall's side ends, achieving quoins with an apparent finish, considering its coupling into the piers (820), which pass through the quoin blocks (955) across their vertical tunnel (307).

When the corner block (955) complements with a ducting block (953) with a notch (306) in the channel (302), the intermediate wall (211), in its top surface, has a cutout (308) in the material, which is attached to the notch (306) in the longitudinal channel (302). This allows for the ducting to be placed vertically through the vertical tunnel (307) of the quoin blocks (955) and allows said ducting to have an elbow joint so that the ducting can horizontally enter into the wall, through a course of ducting blocks (953).

When the quoin block (955) complements a plinth block (950), the intermediate wall (211) is separated from the channel (302) by the cavity (204), allowing the adhesive (301) to be poured through it.

A second embodiment of said quoin blocks (955) corresponds to a continuation block (956), the only difference being that the side edges (122) of the rectangular prisms (100), corresponding to its outer wall (210), have notches (130), or in another embodiment, ridges (131). This allows putting a pier (820) or ducting in an intermediate section of the wall being built, while adjacent blocks equipped with coupling means at both sides are able to be coupled to said continuation block (956).

In one embodiment of the continuation block (956), one or both rectangular prisms (100) have an opening (123) preferably rectangular either in the lower edge (121) or in the upper edge (120), at the height of the vertical tunnel (307), crossing through the rectangular prism (100) from its front face (101) to said vertical tunnel (307). This allows to horizontally take a ducting (830) installed through the vertical tunnel (307) out of the wall, by placing a block equipped with coupling means having an opening (123) on the lower edge (121) on a block equipped with coupling means having an opening (123) in the upper edge (120). Said opening (123) may also be present in any block equipped with coupling means having a vertical tunnel (307), as in the ending block (952) or quoin block (955). With these designs of blocks equipped with coupling means, unnecessary volumes present in the building blocks are eliminated, so that their weight is reduced and savings are achieved in their manufacture. The different embodiments of blocks equipped with coupling means correspond to specific needs in the construction of walls: a) plinth, b) ducting installations, c) uniform apparent finish, d) reinforcement, f) ease of construction due to its coupling features.

A sixth embodiment of the block equipped with coupling means is the ending block (952), which consists of the end section of the quoin block (955) containing the vertical tunnel (307). Said ending block (952) has either ridges (131) or grooves (130) in one or more of its sides. This allows for the use of the ending block (952) to finish the endings where two, three or four walls join together, leaving an apparent finish without the need to split quoin blocks (955) in half.

The method of building walls using the blocks equipped with coupling means consists of, first of all, achieving a perfectly leveled plinth surface (800), since the evenness of the courses depends on the leveling of this surface. The plinth surface (800) must have its piers (820) or ribs prepared for the construction of the wall. Likewise, places must be spotted in the plinth surface where vertical ducting (830) for installations is to be arranged. Also, fixings (810) might be secured on the plinth surface to further enhance the wall's strength, particularly in seismic zones. The separation distance between one fixing (810) and another must correspond to twice the distance between the cavity (204) of the plinth block (950) and its side edge (122). Then, quoin blocks (955) for course of plinth blocks (950) are placed, inserting the piers (820) or the ribs through the vertical tunnel (307) of the quoin block (955). Next, a plinth block (950) is placed adjacent to the quoin blocks (955) by coupling the ridges (131) of a block equipped with coupling means into the grooves (130) of the adjacent block equipped with coupling means. After that, a plurality of plinth blocks (950) are placed along the plinth surface (800) so that the fixings (810) fit into the cavities of the plinth blocks (950) and coupling the ridges (131) from one plinth block (950) into the grooves (130) from the adjacent plinth block (950). In places of the plinth course where vertical ducting (830) is to be arranged, a continuation block (956) for plinth course is placed, so that the ducting (830) is inserted into the vertical tunnel (307), and the ridges (131) of the continuation block (956) fit into the grooves of the adjacent plinth block (950) and vice versa.

Once the placement of the plinth course is done, adhesive (301) is poured on the channel (302) of the plinth course and introduced through the cavities (204) and vertical cavities (303) of the plinth blocks (950), and the channel (302) is completely covered by the adhesive (301). Immediately after that, before the adhesive sets, quoin blocks (955) for course are placed in the piers (820), oriented at 90° relative to the quoin blocks (955) of the previous course, alternating its orientation from one course to another to achieve the fabric of the courses. Also, lightened blocks (951) are placed over the channel (302) that has already been filled with adhesive (301), so that the ridges (131) of a block equipped with coupling means fit into the grooves (130) of the adjacent block equipped with coupling means. The bases (207) of the lightened blocks (951) displace the adhesive (301) still unset in the channel (302) to bring it to the surfaces of the cavity (300). Where there are continuation blocks (956) in the plinth course, there is also a continuation block (956) placed in the next course, but turning it by 180° on its vertical tunnel (307). Thus, the vertical tunnel (307) of a continuation block (956) is exactly aligned with the vertical tunnel (307) of the continuation block (956) from the previous course, but the ends of the continuation blocks (956) not containing the vertical tunnels (307) are oriented in opposite directions to achieve the fabric of the courses. Then, several courses are placed on top in the same manner until the desired height is achieved.

At the height of the wall where ducting (830) is to be arranged horizontally, lightened blocks (951) adjacent to a continuation block (956) in a course, are replaced with ducting blocks (953) with a notch (306) in the channel (302), as many as required for the ducting (830) to reach the required distance in the wall. Likewise, quoin blocks (955) and continuation blocks (956) containing the cutout (308) in their intermediate wall (211) are used. At the end of a ducting (830), whether it is arranged horizontally or vertically, a continuation block (956) with opening (123) in its upper edge (120) is placed. After that, ducting (830) is placed and the adhesive (301) is poured in the channel (302), introducing it into the vertical cavities (303).

In the course immediately above, ducting blocks (953) with a notch (306) in the base (207) are placed on the ducting blocks (953) with a notch (306) in the channel (302). Another option is to place ducting blocks (953) with notches (306) both in the channel (302) and in the base (207), to place ducting (830) in two consecutive courses.

Where it is required to build a window or door frame, as many blocks equipped with coupling means as required are replaced with a beam. At the ends of the beam, piers (320) are placed and on top of said piers (320), quoin blocks (955) and ending blocks (952) are alternately placed to build the side posts of the frame. In courses where the piers (320) of the frame end, blocks equipped with coupling means are replaced by a beam (840). In some courses, reinforcement blocks (954) can be placed from one pier (820) to another to install a post-tension cable or rebar to join the two piers (208) for added structural strength to the wall.

Having described my invention thoroughly, I consider it a novelty and therefore I claim as my exclusive property, what is contained in the following claims:

1. A system for constructing walls using blocks equipped with coupling means, the blocks including a plinth block, a lightened block, a continuation block, a ducting block with a notch in the channel, a ducting block with a notch in the base, a ducting block with a notch in the channel and another notch in the base, a reinforcement block and an ending block;

wherein the plinth block comprises four elements, wherein two of said elements are rectangular prisms parallel to each other, wherein its front faces are proportionally larger in area than its top, bottom and side faces which form its upper edge, lower edge and side edges respectively;

wherein said rectangular prisms form the inner and outer faces of the wall being built with the blocks equipped with coupling means;

wherein said rectangular prisms are separated by two trapezoidal prisms whose cross section has a rectangular trapezoid profile, with a trapezoidal prism face corresponding to the only not-orthogonal side of the rectangular trapezoid facing downwards;

wherein said trapezoidal prisms are arranged opposite to each other on one side, said sides corresponding to the minor base of said rectangular trapezoid profile of each trapezoidal prism; wherein there is a cavity between said sides;

wherein the central part of the bottom surface of the plinth block corresponding to the lower faces of the trapezoidal prisms form two slopes relative to the horizontal at an angle that rises from the ends of the plinth block towards its center where the cavity is, but without reaching or crossing with the upper surfaces of the trapezoidal prisms;

wherein the lowest point of the slopes is raised above the lower edge of both rectangular prisms forming a cavity;

wherein the trapezoidal prism surfaces corresponding to the rectangular trapezoid profile are attached to the rectangular prisms;

wherein the upper edge of both rectangular prisms is elevated above the upper surfaces of the trapezoidal prisms which correspond to the perpendicular side of the rectangular trapezoid profile;

wherein a channel is formed on top of the plinth block with the cavity in its center;

wherein the side surface of the trapezoidal prisms opposite to the cavity is recessed relative to the side edges of both rectangular prisms forming a vertical cavity;

wherein the lightened block comprises three elements, wherein two of said three elements are rectangular prisms parallel to each other whose front faces are proportionally larger in area than its top, bottom and side faces, which form its upper edge, lower edge and side edges respectively;

wherein said rectangular prisms form the inner and outer sides of the wall being built with the blocks equipped with coupling means;

wherein said rectangular prisms are separated by a third inner element comprising two trapezoidal prisms whose cross section forms a rectangular trapezoid profile, with the side of the trapezoidal prism corresponding to the only non-orthogonal side of the rectangular trapezoid facing downwards;

wherein said trapezoidal prisms are arranged opposite to each other on one side, said side corresponding to the minor base of the rectangular trapezoid profile;

wherein both trapezoidal prisms are adjoined by a bridge at the center of the lightened block forming a channel without a cavity in the center of the lightened block;

wherein each of the trapezoidal prisms has on the bottom and near each of the ends of the lightened block, a base whose lower surface is horizontal and protruding from the lower edge of the rectangular prisms;

wherein the height of the protrusion forming said base, is less than the height of the walls of the channel on the upper face of the blocks except for the ending block, which has no channel;

wherein the slope of the trapezoidal prisms is steeper in the lightened block compared to that of the plinth block starting from the lower base of the bridge towards the bottom edge of the rectangular prism, thereby forming a cavity;

wherein the trapezoidal prism surfaces corresponding to the rectangular trapezoid profile forming the central part of the lightened block are attached to the rectangular prisms;

wherein the channel is formed on top of the lightened block;

wherein the upper edge of both rectangular prisms is elevated relative to the channel;

wherein the side surfaces of the third central element formed by the trapezoidal prisms and the bridge are recessed relative to the side edges of both rectangular prisms forming a vertical cavity;

wherein the side faces of the bases are inclined from the lower edge of the rectangular prisms and towards its center; wherein said inclination is equal to the inclination of the walls of the channel;

wherein the continuation block comprises three elements, wherein two of said elements are rectangular prisms, parallel to each other, whose front faces are proportionally larger in area than its top, bottom and side faces forming its upper edge, lower edge and side edges respectively;

wherein said rectangular prisms form the inner and outer sides of the wall being built with the blocks equipped with coupling means;

wherein said rectangular prisms are separated by a third central element placed downwards relative to the rectangular prisms forming a channel on the top and a base whose lower surface is horizontal and protruding from the lower edge of said rectangular prisms; wherein the height of the protrusion forming said base is less than the height of the walls of the channel on the top of the blocks except for the ending block, which has no channel;

wherein the upper edge of both rectangular prisms is raised relative to the channel;

wherein the side surfaces of the third element are recessed relative to the lateral edges of both rectangular prisms forming a vertical cavity;

wherein the side faces of the base have an inclination from the lower edge of said rectangular prisms and towards the center, wherein said inclination is equal to the inclination of the walls of the channel;

wherein the ducting block with a notch in the channel comprises three elements, wherein two of said elements are rectangular prisms, parallel to each other, whose front faces are proportionally larger in area than its top, bottom and side faces, forming its upper edge, lower edge and side edges respectively;

wherein said rectangular prisms form the inner and outer faces of the wall being built with the blocks equipped with coupling means;

wherein said rectangular prisms are separated by a third central element placed downwards relative to said rectangular prisms forming a channel on top and a base whose lower surface is horizontal and protruding relative to the lower edge of said rectangular prisms;

wherein the height of the protrusion forming said base is less than the height of the walls of the channel on the top of the blocks except for the ending block which has no channel;

wherein the upper edge of both rectangular prisms is elevated relative to the channel;

wherein the side surfaces of the third central element are recessed relative to the side edges of both rectangular prisms, forming a vertical cavity; wherein the side faces of the base have an inclination from the lower edge of said rectangular prisms and towards the center, wherein said inclination is equal to the inclination of the walls of the channel;

wherein the base extends continuously from end to end thereof; wherein the channel has a longitudinal notch in the middle section, being semicircular, crossing the channel from one end of the ducting block to its opposite end;

wherein the ducting block with a notch in the base comprises three elements, wherein two of said elements are rectangular prisms parallel to each other, whose front faces are proportionally larger in area than its top, bottom and side faces, forming its upper edge, lower edge and side edges respectively;

wherein said rectangular prisms form the inner and outer sides of the wall being built with the blocks equipped with coupling means, wherein said rectangular prisms are separated by a third central element placed downwards relative to the rectangular prisms, forming a channel on top and a base whose lower surface is horizontal and protruding relative to the lower edge of said rectangular prisms, wherein the height of the protrusion forming said base is less than a height of the walls of the blocks except for the ending block which has no channel;

wherein the upper edge of both rectangular prisms is elevated relative to the channel;

wherein the side surfaces of the third central element are recessed relative to the side edges of both rectangular prisms, forming a vertical cavity; wherein the side faces of the base have an inclination from the lower edge of said rectangular prisms and towards the center, wherein said inclination is equal to the inclination of the walls of the channel;

wherein the base extends continuously from end to end thereof; wherein the base has a longitudinal notch at the center of semicircular section, crossing the base from one end of the ducting block to the opposite end;

wherein the ducting block with a notch in the channel and another notch in the base comprises three elements, wherein two of said elements are rectangular prisms, parallel to each other, whose front faces are proportionally larger in area than its top, bottom and side faces, which form its upper edge, lower edge and side edges respectively;

wherein said rectangular prisms form the inner and outer sides of the wall being built with the blocks equipped with coupling means;

wherein said rectangular prisms are separated by a third central element placed downwards relative to the rectangular prisms forming a channel on top and a base whose lower surface is horizontal and protruding relative to the lower edge of said rectangular prisms;

wherein the height of the protrusion forming said base is less than the height of the walls of the channel on the top of the blocks except for the ending block, which has no channel;

wherein the upper edge of both rectangular prisms is elevated relative to the channel;

wherein the side surfaces of the third central element are recessed relative to the side edges of both rectangular prisms, forming a vertical cavity;

wherein the lateral faces of the base have an inclination from the lower edge of said rectangular prism and towards the center, wherein said inclination is equal to the inclination of the walls of the channel; wherein the base extends continuously from end to end thereof; wherein the channel has a longitudinal notch at the center, being of semicircular section, crossing the channel from one end of the ducting block to the opposite end, and the base has a longitudinal notch at the center, being of semicircular section, crossing the base from one end of the ducting block to the opposite end;

wherein the reinforcement block, comprises three elements, wherein two of said elements are rectangular prisms, parallel to each other, whose front faces are proportionally larger in its area than its top, bottom and side faces, forming its upper edge, lower edge and side edges respectively; wherein said rectangular prisms form the inner and outer sides of the wall being built with the blocks equipped with coupling means;

wherein said rectangular prisms are separated by a third central element placed downwards relative to said rectangular prisms, forming a channel on the top and a base whose bottom surface is horizontal and protruding relative the lower edge of said rectangular prisms;

wherein the height of the protrusion forming said base, is less than the height of the walls of the channel on the top of the blocks except for the ending block, which has no channel;

wherein the upper edge of the both rectangular prisms is elevated relative to the channel;

wherein the side surfaces of the third central element are recessed relative to the side edges of both rectangular prisms, forming a vertical cavity;

wherein the lateral faces of the base have an inclination from the lower edge of said rectangular prisms and towards the center, wherein said inclination is equal to the inclination of the walls of the channel; wherein the base extends continuously from end to end thereof;

wherein the third central element has a longitudinal perforation crossing through the reinforcement block from side to side at its central portion;

wherein the ending block comprises a vertical tunnel crossing the block from top to bottom, wherein said vertical tunnel has an octagonal profile; wherein said vertical tunnel is surrounded by four walls, wherein two of said walls are formed by rectangular prisms; wherein a third and fourth wall corresponds to the outer walls of the block so that said outer walls, together with the side edges of said rectangular prisms correspond to the other two sides of the block.

2. The system for constructing walls using blocks equipped with coupling means according to claim 1, wherein said blocks have, on one of the side edges of each rectangular prism, a groove arranged vertically, oriented preferably at the center of the side edge, while the opposite side edge has a ridge arranged vertically, oriented correspondingly with the orientation of the groove in the former side edge.

3. The system for constructing walls using blocks equipped with coupling means according to claim 1, wherein the side surfaces of the rectangular prisms corresponding to the walls of the channel in each type of block have an inclination between 5° and 45°, starting from the border of the upper edge of each rectangular prism and opening towards the center of the block.

4. The system for constructing walls using blocks equipped with coupling means according to claim 1, wherein all visible surfaces of the trapezoidal prisms have a roughened or textured finish.

5. The system for constructing walls using blocks equipped with coupling means according to claim 1, wherein all visible surfaces of said third element have a roughened or textured finish.

6. The system for constructing walls using blocks equipped with coupling means according to claim 1, having, at an end section a block equipped with coupling means called quoin block, having a vertical tunnel extending along the quoin block from top to bottom; wherein said vertical tunnel has an octagonal profile; wherein said vertical tunnel is surrounded by four walls, wherein two of said walls are formed by the rectangular prisms; wherein a third wall corresponds to the outer wall of the quoin block so that said outer wall, together with the side edges of said rectangular prisms, corresponds to one of the sides of the quoin block altogether; wherein the side edges of said rectangular prisms have neither a ridge nor a groove, so that the outer wall is completely smooth in its outer side; wherein an intermediate wall stands between the vertical tunnel and the rest of the quoin block; wherein said quoin block has neither bottom base nor top channel at its end section corresponding to said vertical tunnel bounded by said rectangular prisms, said outer wall and said intermediate wall.

7. The system for constructing walls using blocks equipped with coupling means according to claim 1, wherein at an end section a block equipped with coupling means called quoin block, having a vertical tunnel extending along the quoin block from top to bottom, wherein said vertical tunnel has an octagonal profile; wherein said vertical tunnel is surrounded by four walls, wherein two of said walls are formed by said rectangular prisms; wherein a third wall corresponds to the outer wall of the quoin block so that said outer wall, together with the side edges of said rectangular prisms, correspond to one of the sides of the quoin block altogether; wherein the side edges of said rectangular prisms have neither a ridge nor a groove, so that the outer wall is completely smooth on its outer side; wherein an intermediate wall stands between the vertical tunnel and the rest of the quoin block; wherein said quoin block has neither bottom base nor top channel at its end section corresponding to said vertical tunnel bounded by said rectangular prisms, the outer wall and the intermediate wall; wherein the intermediate wall, at its upper part, has a cutout, which is adjoined to the longitudinal notch in the channel.

8. The system for constructing walls using blocks equipped with coupling means according to claim 6, wherein the intermediate wall is separated from the channel by a cavity.

9. The system for constructing walls using blocks equipped with coupling means according to claim 6, wherein said quoin block has grooves at the side edges of said rectangular prisms, which correspond to the outer wall.

10. The system for constructing walls using blocks equipped with coupling means according to claim 6, wherein said quoin block has ridges at the side edges of said rectangular prisms, which correspond to the outer wall.

11. The system for constructing walls using blocks equipped with coupling means, according to claim 1, wherein said ending block has ridges and grooves in one or more of its sides.

12. A wall construction method using the blocks equipped with coupling means of claim 6, comprising the steps of:

a) achieve a perfectly leveled plinth surface;

b) have piers or ribs placed in the desired locations;

c) locate places on the plinth surface where ducting for vertical installations will be arranged;

d) anchor fixings on the plinth surface with a separation distance between a fixing and another corresponding to twice the distance between the cavity of the plinth block and its side edges;

e) position the quoin blocks for plinth block course, inserting the pier or the rib through the vertical tunnel of the quoin block;

f) place a plinth block adjacent to the quoin blocks coupling the ridges of one block equipped with coupling means in the grooves of the adjacent block equipped with coupling means;

g) place a plurality of plinth blocks along the plinth surface so that the fixings fit into the cavities of the plinth blocks and coupling the ridges of one plinth block into the grooves of the adjacent plinth block;

h) place a continuation block for plinth course in the places of the plinth surface where ducting for vertical installations are to be arranged, so that the ducting is introduced into the vertical tunnel and the ridges of the continuation block fit into the grooves of the adjacent plinth block and vice versa;

i) once the plinth course is arranged, pour adhesive on the channel of the plinth course introducing it into the cavities and the vertical cavities of the plinth blocks, so that the channel is completely covered by the adhesive;

j) before the adhesive sets, place the quoin blocks for course in the piers, oriented at 90° relative to the quoin blocks of the previous course, alternating the orientation from one course to another to obtain the courses of the wall;

k) place lightened blocks over the channel that has already been filled with adhesive, so that the ridges of a block equipped with coupling means fit into the grooves of the adjacent block equipped with coupling means;

l) displace the adhesive still unset in the channel with the bases of the lightened blocks, to bring it to the surfaces of the cavity;

m) where there are continuation blocks in the plinth course, place continuation blocks in the next course, but turning them by 180° on the vertical tunnel so that the vertical tunnel of a continuation block remains exactly aligned with the vertical tunnel of the plinth block from the previous course, but the ends of the continuation block not containing the vertical tunnels are oriented in opposite directions to achieve the courses of the wall;

n) place more courses in the same manner up to the desired height;

o) at the height of the wall where ducting for horizontal installations need to be arranged, replace lightened blocks adjacent to the continuation blocks in that course for ducting blocks with a notch in the channel, as many as required for the ducting to reach the required distance in the wall; likewise, place quoin blocks and continuation blocks containing the cutout in its intermediate wall;

p) in the end of the ducting, whether it is arranged horizontally or vertically, place a continuation block with opening in the upper edge;

q) place ducting for sanitary or electrical installations;

r) apply adhesive on the channel, so that it is inserted into the vertical cavities;

s) in the course immediately above, place ducting blocks with a notch in the base on the ducting blocks with a notch in the channel;

t) where it is required to build a window or door frame, replace as many blocks equipped with coupling means as necessary with a beam;

u) place piers at the ends of the beam;

v) on said piers, place quoin blocks and ending blocks in an alternate fashion to build the side posts of the frame;

w) in the course where the piers of the frame end, replace blocks equipped with coupling means with a beam.

13. The wall construction method using the blocks equipped with coupling means according to claim 12, wherein: x) for some courses, reinforcement blocks from one pier to another are placed to install a post-tension cable or rebar to join the two piers to provide more structural strength to the wall.

14. The wall construction method using the blocks equipped with coupling means according to claim 12, wherein: y) ducting blocks with notches both in the channel and in the base are placed, to arrange ducting for sanitary or electrical installations in two consecutive courses.

* * * * *